US009376797B2

(12) United States Patent
Yang

(10) Patent No.: US 9,376,797 B2
(45) Date of Patent: Jun. 28, 2016

(54) BOLTED STEEL CONNECTIONS WITH 3-D JACKET PLATES AND TENSION RODS

(71) Applicant: WeiHong Yang, Sunnyvale, CA (US)

(72) Inventor: WeiHong Yang, Sunnyvale, CA (US)

( * ) Notice: Subject to any disclaimer, the term of this patent is extended or adjusted under 35 U.S.C. 154(b) by 0 days.

(21) Appl. No.: 14/198,548

(22) Filed: Mar. 5, 2014

(65) Prior Publication Data

US 2014/0182234 A1 Jul. 3, 2014

Related U.S. Application Data

(63) Continuation-in-part of application No. 13/625,869, filed on Sep. 24, 2012, now Pat. No. 8,800,239, which is a continuation-in-part of application No. 12/804,602, filed on Apr. 19, 2010, now abandoned.

(51) Int. Cl.

| | |
|---|---|
| ***E04B 1/38*** | (2006.01) |
| ***E04B 1/24*** | (2006.01) |
| *E04C 3/04* | (2006.01) |

(52) U.S. Cl.

CPC ..... *E04B 1/2403* (2013.01); *E04B 1/24* (2013.01); *E04B 2001/2415* (2013.01); *E04B 2001/2418* (2013.01); *E04B 2001/2445* (2013.01); *E04B 2001/2448* (2013.01); *E04B 2001/2463* (2013.01); *E04B 2001/2496* (2013.01); *E04C 2003/0495* (2013.01)

(58) Field of Classification Search

CPC ..... E04B 1/2403; E04B 1/2406; E04B 2001/2415; E04B 2001/2418; E04B 2001/2448; E04B 2001/2445; E04B 2001/2496; E04B 2001/2644; E04B 2001/2608; E04B 2001/2652; E04C 3/40

See application file for complete search history.

(56) References Cited

U.S. PATENT DOCUMENTS

| | | | | | |
|---|---|---|---|---|---|
| 1,729,586 | A | * | 9/1929 | Liebman | 403/295 |
| 2,732,654 | A | | 1/1956 | Sullivan | |
| 2,931,129 | A | | 4/1960 | Boniface | |
| 3,099,468 | A | | 7/1963 | Meyerdick | |
| 3,414,300 | A | | 12/1968 | Spane | |
| 3,425,720 | A | | 2/1969 | Spane | |
| 3,846,030 | A | | 11/1974 | Katt | |
| 3,987,872 | A | | 10/1976 | Sabes | |
| 4,024,691 | A | | 5/1977 | Hansen | |
| 4,315,386 | A | | 2/1982 | Clarke | |
| 4,330,221 | A | | 5/1982 | Stumm | |
| 4,335,555 | A | | 6/1982 | Southerland et al. | |
| 4,411,547 | A | | 10/1983 | Johnson | |
| 4,551,957 | A | | 11/1985 | Madray | |
| 4,688,358 | A | | 8/1987 | Madray | |
| 4,697,393 | A | | 10/1987 | Madray | |
| 4,974,387 | A | | 12/1990 | Dufour | |
| 5,156,484 | A | | 10/1992 | Allen | |
| 5,403,110 | A | * | 4/1995 | Sammann | 403/234 |
| 5,503,493 | A | | 4/1996 | Kato et al. | |
| 5,524,397 | A | | 6/1996 | Byers et al. | |
| 5,577,353 | A | | 11/1996 | Simpson | |
| 5,660,005 | A | | 8/1997 | Tacoma | |

(Continued)

*Primary Examiner* — Robert Canfield

(74) *Attorney, Agent, or Firm* — Law Office of Dorian Cartwright; Dorian Cartwright

(57) ABSTRACT

A three-dimensional jacket-plate connector connects at least two members. The jacket-plate connector comprises first and second three-dimensional jacket plates. Each jacket plate comprises a single continuous side web and segments of combined flanges perpendicular to, and located around the perimeter of, the side web. With all interior flanges notched out, the side web and perimeter flanges envelopes a void interior space without obstacles against accommodation of I-beam members installed from all directions.

15 Claims, 26 Drawing Sheets

(56) References Cited

U.S. PATENT DOCUMENTS

| | | | | |
|---|---|---|---|---|
| 6,327,823 | B1 * | 12/2001 | Emms | 52/93.2 |
| 6,516,583 | B1 | 2/2003 | Houghton | |
| 6,516,584 | B1 | 2/2003 | Rudd | |
| 6,941,718 | B1 | 9/2005 | diGirolamo et al. | |
| 7,299,596 | B2 | 11/2007 | Hildreth | |
| 7,310,920 | B2 | 12/2007 | Hovey, Jr. | |
| 933,067 | A1 | 9/2009 | Ferry | |
| 7,856,763 | B2 | 12/2010 | Keys et al. | |
| 8,028,494 | B2 | 10/2011 | Denn et al. | |
| 8,720,839 | B2 * | 5/2014 | Lijesnic | 248/300 |
| 2003/0031077 | A1 * | 2/2003 | Emms | 365/230.03 |
| 2007/0209312 | A1 * | 9/2007 | Keys et al. | 52/696 |
| 2008/0178551 | A1 | 7/2008 | Porter | |
| 2009/0007520 | A1 | 1/2009 | Navon | |
| 2010/0044524 | A1 | 2/2010 | Sugaya et al. | |
| 2010/0086348 | A1 | 4/2010 | Funahashi et al. | |
| 2011/0252743 | A1 | 10/2011 | Yang | |
| 2011/0308063 | A1 | 12/2011 | Feeleus | |
| 2014/0083046 | A1 | 3/2014 | Yang | |

* cited by examiner

BOLTED STEEL CONNECTIONS WITH 3-D JACKET PLATES AND TENSION RODS

CROSS-REFERENCE TO RELATED APPLICATIONS

This application claims the benefit of priority under 35 U.S.C. 120 as a continuation-in-part to U.S. patent application Ser. No. 13/625,869, filed on Sep. 24, 2012, and entitled BOLTED STEEL CONNECTIONS WITH 3-D JACKET PLATES AND TENSION RODS, by WeiHong Yang, which is a continuation-in-part of U.S. patent application Ser. No. 12/804,602, filed on Apr. 19, 2010, and entitled BOLTED STEEL CONNECTIONS WITH 3-D JACKET PLATES AND TENSION RODS, by WeiHong Yang, the contents of each being hereby incorporated by reference in their entirety.

FIELD OF THE INVENTION

The present invention relates generally, to construction material, and more specifically, to a steel jacket plate connector.

BACKGROUND

During construction of steel frames and trusses, individual members such as beams and columns are connected together to form a structure. Conventionally, two-dimensional gusset plates are used to connect steel members with either welding or bolts, or their combinations.

However, connecting steel beams requires a degree of physical fitness and expertise that can make it a difficult job. Typically, each connection is custom fit on site while steel members are held in place. The labor cost of welders assembling connectors on site can be prohibitive. Moreover, the time to construct a structure is lengthened by the connections because adjacent members cannot be added until a supporting member is secured.

Furthermore, welding congestion, which constrains deformation capability of a connection, has been a major structural problem for conventional steel structural connections for years. Under cyclic seismic load conditions, the welding congestion creates a stress concentration in three-dimensional tensile stress status, and causes unwanted brittle tensile failure.

What is needed is a technique to allow stronger, more ductile connections that can be installed faster at lower cost.

SUMMARY OF THE INVENTION

The above needs are met by an apparatus, system, method and method of manufacture for a three-dimensional jacket-plate connector.

In one embodiment, the 3-D connector comprises first three-dimensional jacket plate. A second three-dimension jacket plate that is a mirror image of the first three-dimensional jacket plate. The two jacket plates are bolted to opposite sides of a joint of the steel I-beam members.

In another embodiment, a jacket plate comprises a primary C-channel welded to a branching C-channel that intersect to match angles of the joint formed by a primary I-beam member and a connected I-beam member.

Advantageously, the 3-D jacket connection can achieve exceptional structural performance, including higher strength and ductility, stronger yet simpler connections, higher quality, small components for easy storage and transportation. It also provides easy installation to increase the speed and reduce the price of erecting steel structures. The 3-D jacket connection addresses all possible connection type in such a simple and yet consistent manner that it is practically a versatile connections system that can be use in any steel frames and trusses that is made of wide-flanged steel I-beam sections.

BRIEF DESCRIPTION OF THE FIGURES

In the following drawings like reference numbers are used to refer to like elements. Although the following figures depict various examples of the invention, the invention is not limited to the examples depicted in the figures.

DETAILED DESCRIPTION

An apparatus, system, method, and method of manufacture for a three-dimensional jacket-plate connector to connect at least two members that are wide-flanged steel I-beam sections, are described herein. The following detailed description is intended to provide example implementations to one of ordinary skill in the art, and is not intended to limit the invention to the explicit disclosure, as one of ordinary skill in the art will understand that variations can be substituted that are within the scope of the invention as described.

System Overviews (FIGS. 1 and 2)

Figure 1A:
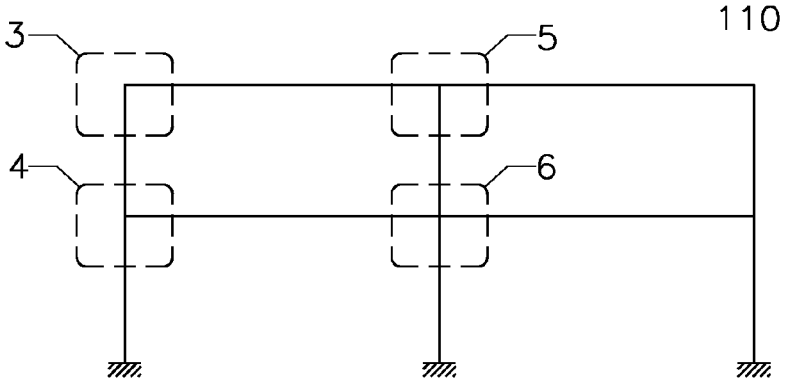
FIGS. 1A-E are schematic diagrams illustrating steel frames, according to some embodiments.
Figure 1B:
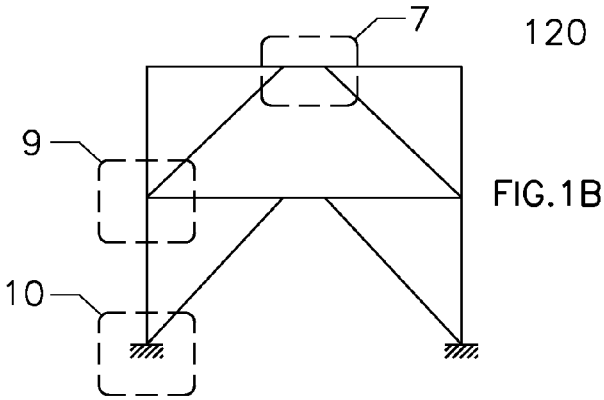
Figure 1C:
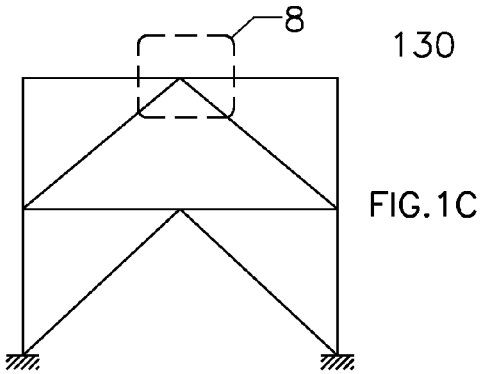

FIGS. 1A-E are schematic diagrams illustrating steel frames, according to some embodiments. The steel frames are composed of steel I-beam sections that connect at a joint. The label numbers associated with the joints in FIGS. 1A-E correspond to figure numbers that further detail the joint. More particularly, FIG. 1A shows a steel frame with moment connections 3, 4, 5 and 6 further detailed in FIGS. 3A-B, 4A-B, 5A-B and 6A-B; FIG. 1B shows an eccentrically braced frame (EBF) with moment connections 7, 9 and 10, further detailed in FIGS. 7A-D, 9A-D and 10A-D, respectively; and FIG. 1C shows a specially concentrically braced frame (SCBF) with a moment connection 8 further detailed in FIG. 8A-D.

Figure 2A:
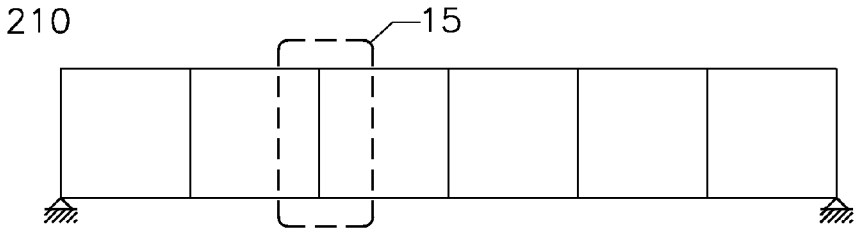
FIGS. 2A-D are schematic diagrams illustrating steel trusses, according to some embodiments.
Figure 2B:
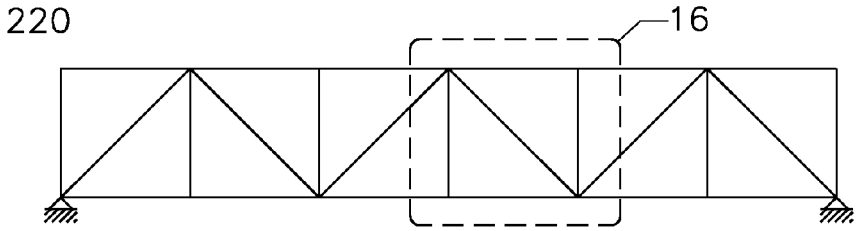
Figure 2C:
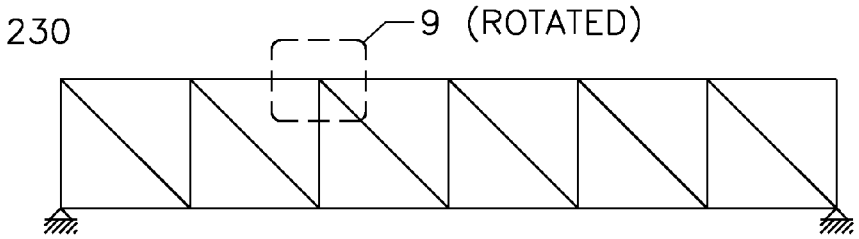

FIGS. 2A-D are schematic diagrams illustrating steel trusses, according to some embodiments. The label numbers associated with the joints in FIGS. 2A-D correspond to figure numbers that further detail the joint. Specifically, FIG. 2A illustrates a Vierendeel truss connection condition 15 further detailed in FIGS. 15A-C, FIG. 2B shows a steel bridge truss segment further detailed in FIGS. 16A-B, FIG. 2C shows an EBF and an inverted V SCBF with a moment connection 9 further detailed in FIGS. 9A-D, and FIG. 2D shows a steel truss with a connection 8 further detailed in FIGS. 8A-D.

Individual 3-D Connector and Accessory Details (FIGS. 3-16)

Figure 3A:
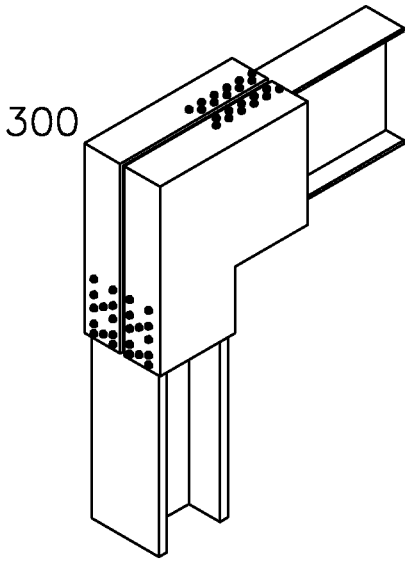
FIGS. 3A-3C are schematic diagrams illustrating a moment connection at a top floor, corner condition, of the steel frame of FIG. 1A, according to some embodiments.
Figure 3B:
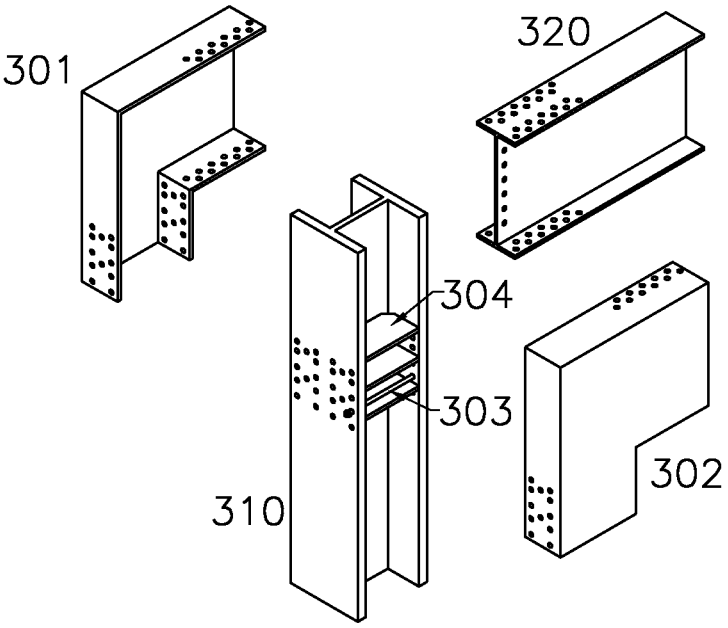

FIGS. 3A-B are schematic diagrams illustrating a moment connection 300 at a top floor, corner condition, of the steel frame of FIG. 1A, according to some embodiments. FIG. 3A shows the moment connection 300 as assembled in the field, while FIG. 3B is an exploded view. The moment connection 300 is an (L)-shaped connection. The top floor corner 300 includes a 3-D connection between, for example, a post 310 (a continuous primary I-beam member) and a beam 320 (a connected secondary I-beam member). The components are also generically referred to herein as members. The 3-D connection includes 3-D jacket plates 301, 302, which are mirror images to each other.

The 3-D jacket plate 301 comprises a continuous primary C-channel 307 and a branching secondary C-channel 308 which are welded together at an intersection 309 to form a single continuous side web 306. The C-channels 307, 308 intersect to match an angle of the joint formed between a longitudinal axis of the beam 320 and a longitudinal axis of the post 310. The webs of intersecting C-channels 307, 308 share a common flat plane.

The 3-D jacket plate 301 also includes two segments of combined flanges 3051 and 3052. The combined flange 3051 consists of an inner flange of the C-channel 307 welded to an inner flange of the C-channel 308, while the combined flange 3052 consists of an outer flange of the C-channel 307 welded to an outer flange of C-channel 308. The combined flanges 3051, 3052 are perpendicular to, and located around, the perimeter of the side web 306. The inner segment of the combined flanges 3051 is formed by notching out an interior portion of a right flange of C-channel 307 along the intersection 309, such that the leftover portion of the right flange of the continuous primary C-channel 307 and the inner flange of the connected secondary C-channel 308 can be welded. Similarly, the outer segment of the combined flange 3052 is formed similar way but with an additional top plate 305 welded to bridge a gap left by the open end of C-channel 307, between flanges of the C-channel 307 and the C-channel 308. Notching is not needed of the outer segment of the combined flange 3052 since there is no part of flange is inside the envelope of the connection.

A void interior space is created with all interior flanges notched out within the side web 306 and perimeter flanges 3051, 3052 of the jacket plate 301. The void interior space allows accommodation of I-beam members installed from all directions without obstacles (e.g., a flange that sets how far I-beam members can be inserted). In further detail, the void interior space allows: (a) insertion of I-beam ends into the moment connection 300; (b) placement of the jacket plate 301 on a flat surface with an interior facing up, placement of the post 310 and the beam 320 over the 3-D jacket plate 301, and then installation of the jacket plate 302 on top with an interior facing down. The void interior space also allows installation of the jacket plates 301, 302 within the span of members, such as a continuous member. In summary, the void interior space caused by the notching allows a simple installation of 3-D jacket plates from opposite sides to I-beam members that are already fixed in-place and fits tightly without substantial gaps in-between members. Although not shown in detail in the remaining figures, one or ordinary skill in the art will recognize that the same principles for configurations of the 3-D jacket plates 301, 302 apply to the alternative configurations shown in those figures.

Furthermore, welding congestion, which constrains the deformation capability of a connection, has been a major structural problem for conventional steel structural connections for years. Under cyclic seismic load conditions, the welding congestion creates a stress concentration in three-dimensional tensile stress status, and causes unwanted brittle tensile failure. Jacket plate connections solve this problem with an unique load transferring path through the joint. The void interior space, created by notching out all interior flanges, forces the load transferring paths to an exterior envelope of the connection. A majority of stress distribution in the jacket plate is two-dimensional stress status, similar to that of a shell type structure. It is well-known that structures with simple two-dimensional stress status are more ductile than those subject to complicated three-dimensional stress status. Since there is no interior load transfer bridges inside the jacket plate, the loading path becomes more uniform and simplified, which results in exceptional, an unexpected, ductile structural performance. In brief, the interior void space without obstacle, caused by notching, optimizes the loading path by removing interior constraints and releasing stress concentration status, such that the overall strength and ductility of the connections is increased.

The post 310 and beam 320 are configured as I-beams or I-beam sections (i.e., two opposing flanges connected by a web). The members 310, 320 are composed of construction-grade steel, or any appropriate material. The sizes are variable. In some embodiments, the post 310 and beam 320 are different sizes because the post 310 typically supports a load of greater magnitude.

The 3-D jacket plates 301, 302 are composed of, for example, steel. The 3-D jacket plates 301, 302 can be substantially identical and mirrored for attachment to opposite sides of the joint. In some embodiments, there are minor variations between the 3-D jacket plates 301, 302, such as in custom installations. The plates can be pre-fabricated off site to match sizes and strength requirements of the structure. Common sizes can be mass produced in a manufacturing facility. The 3-D jacket plates 301, 302 can be formed from C-channels having a web (or side web) plate welded to two flange (or clamping) plates. Alternatively, the 3-D jacket plates 301, 302 can be formed from a side web in the shape of a joint (i.e., (L)-shaped) and clamping plates (i.e. segments of combined flanges) welded around a perimeter of the side web at, for example, a perpendicular angle.

Figure 3C:
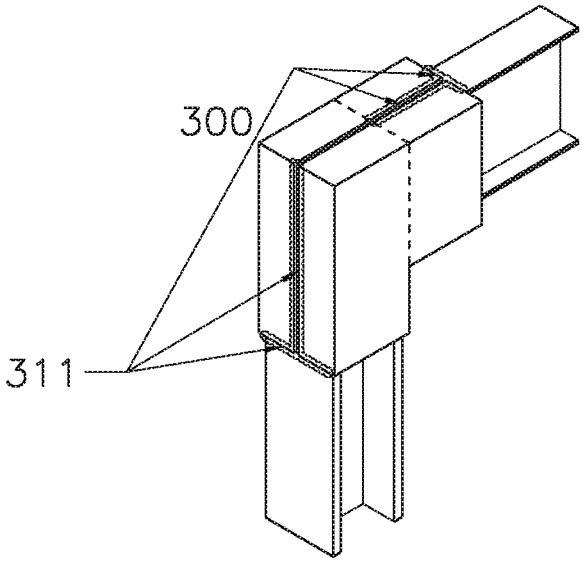

Bolts can be used to connect the 3-D jacket plates 301, 302 to members. In one embedment, a pre-drilled pattern is provided to allow faster installations. Configuration of C-channels of the 3-D jacket plates 301, 302 relative to connected I-beam member 320 allows an installer to fit a hand with a fastening tool into a box gap afforded by opposing flanges of the I-beam and the webs of the C-channel and the I-beam. In one embodiment, clamping flanges of the 3-D jacket plates 301, 302 are welded 311 to corresponding flanges of the continuous primary and the one or more connected secondary I-beam members accommodated inside the jacket plates at the joint as shown in FIG. 3C.

One or more tension rods 303 installed across the depth (i.e., through-the-depth steel rods) of the post 310, in some embodiments, provide additional strength to the primary C-channel of the 3-D jacket plates 301, 302. Although the tension rods 303 are shown as connected to the post 310, this is merely for the purpose of illustration. As installed, the tension rods 303 are connected to the outer portions of the 3-D jacket plates 301, 302 to reinforce against moment forces. More specifically, the vertical shear force is transferred from the beam 320 to the post 310 through a shear tag similar to those of 505 and 605, the rotational moment force is completely transferred, from the beam 320 to the post 310, through the 3-D jacket plates 301, 302. The tension rods 303 help to transfer horizontal shear force associated with the moment force, through an inner flange, to the web of the post 310. In other word, the tension rods 303 reinforce the connector plates 301, 302 from being pulled away from the outer flange.

Stiffener (or web stiffener) plates 304 in the post 310, of other embodiments, provide additional strength to the continued primary I-beam 310. One more stiffener plates 304 are dispersed as needed. The stiffener plates 304, coupled with the tension rods 304, help in transferring bending moment and shear force across the connection.

Figure 4A:
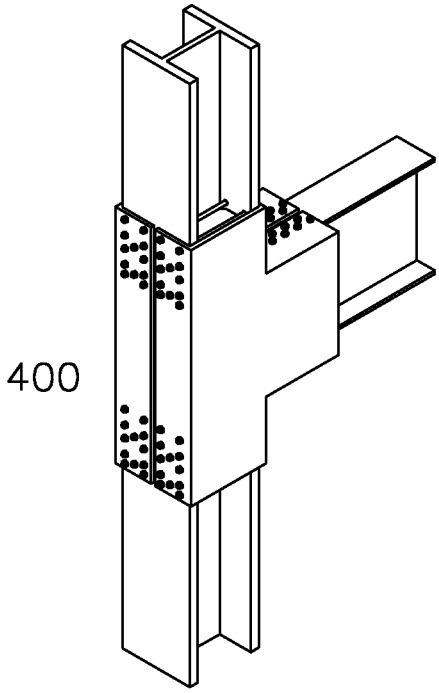
FIGS. 4A-B are schematic diagrams illustrating a moment connection at an intermediate floor, side condition, of the steel frame of FIG. 1A, according to some embodiments.
Figure 4B:
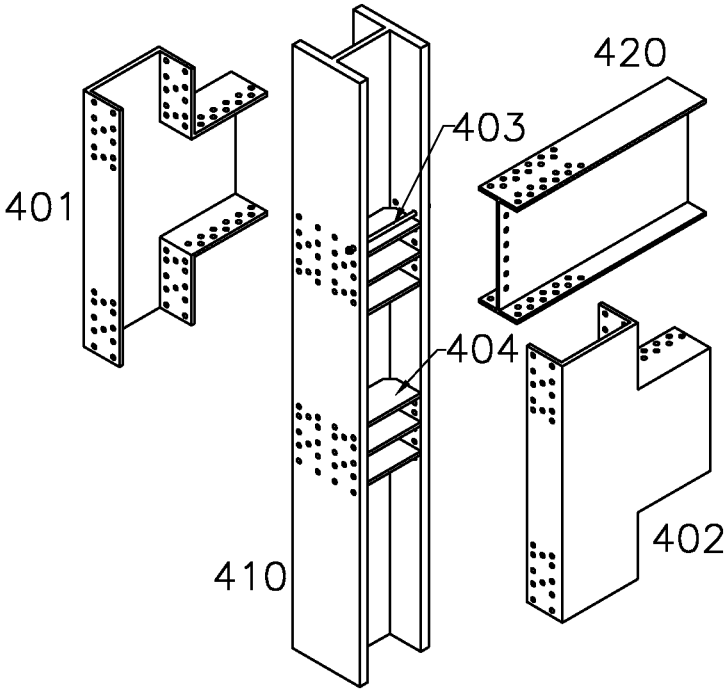

FIGS. 4A-B are schematic diagrams illustrating a moment connection 400 at an intermediate floor, side condition, of the steel frame of FIG. 1A, according to some embodiments.

In this embodiment, the jacket plates 401, 402 have a (T)-shape (rotated), and are substantially mirror in configuration. As an intermediate floor connection, a beam 420 that is supported by a post 410 which continues vertically to provide support for members at higher elevations, such as a top floor or a roof.

The jacket plates 401, 402 have a primary C-channel corresponding to the post 410 and a branching C-channel corresponding to the beam 420. One way to form the jacket plates 401, 402 is to notch out a flange (or clamping) plate of the primary C-channel to allow accommodation for the flanges of beam 420.

Tension rods 403 and stiffener plates 404 are placed to counteract the moment force generated by member 420. Both upper and lower reinforcement are used against both the clockwise and counter clockwise potential rotation of member 420. A shear tag (similar to those of 505 and 605, but not shown) can also be included.

Figure 5A:
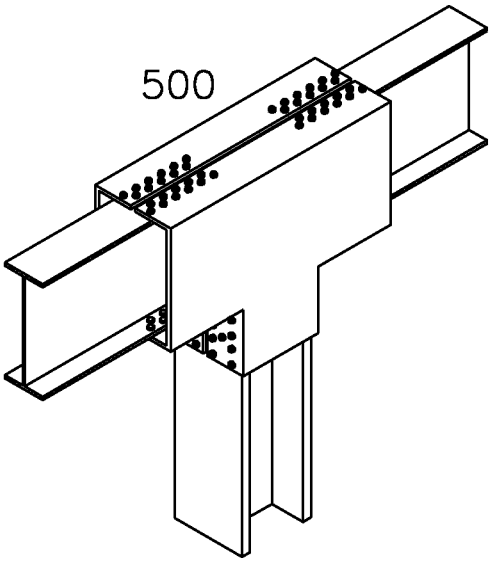
FIGS. 5A-B are schematic diagrams of a moment connection at a top floor, interior bay condition, of the steel frame of FIG. 1A, according to some embodiments.
Figure 5B:
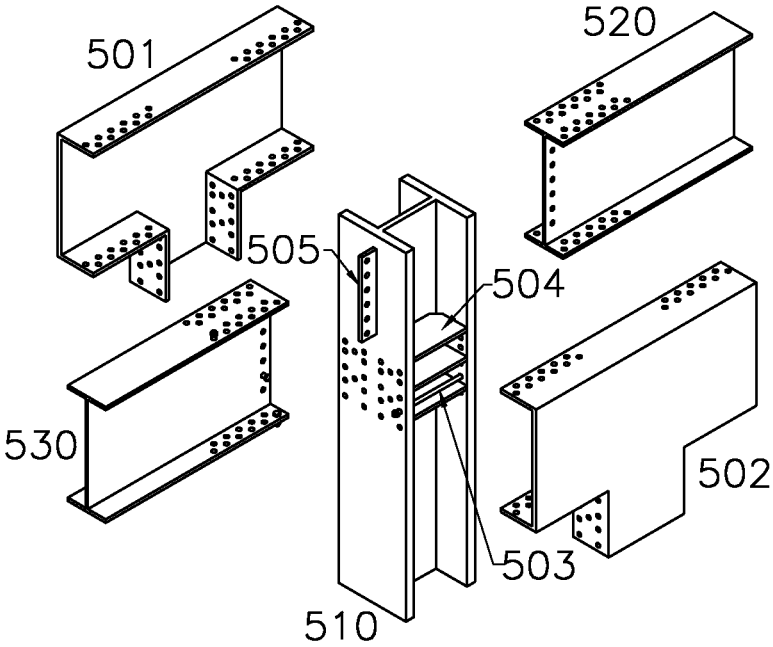

FIGS. 5A-B are schematic diagrams of a moment connection 500 at a top floor, interior bay condition, of the steel frame of FIG. 1A, according to some embodiments.

In this embodiment, the jacket plates 501, 502 have a (T)-shape, and are substantially mirror in configuration. Relative to the moment connection 400 of FIG. 4, the moment connection 500 supports beams on either side of a post rather than at different vertical elevations. Further, tension rods 503 and stiffener plates 504 are dispersed only below the joint. A shear tag 505 is provided to transfer vertical shear forces from I-beam 530 to the post 510. The rotational moment force is completely transferred, from the beams 520 and 530 to the post 510, through the 3-D jacket plates 501, 502.

Figure 6A:
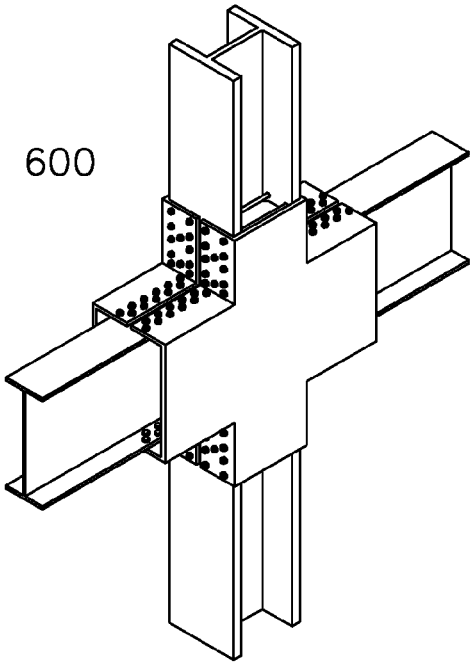
FIGS. 6A-B are schematic diagrams illustrating a moment connection at an intermediate floor, interior bay condition, of the steel frame of FIG. 1A, according to some embodiments.
Figure 6B:
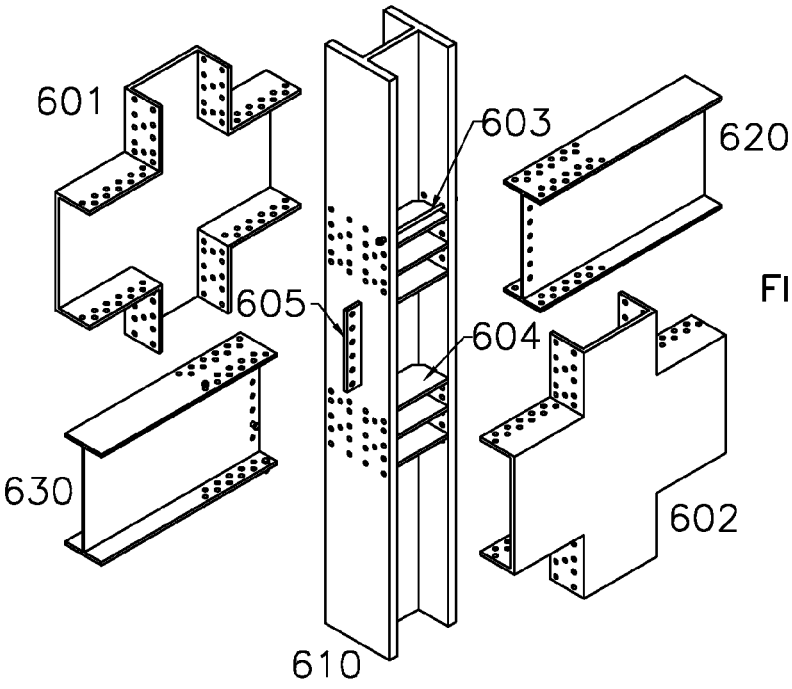
Figure 7A:
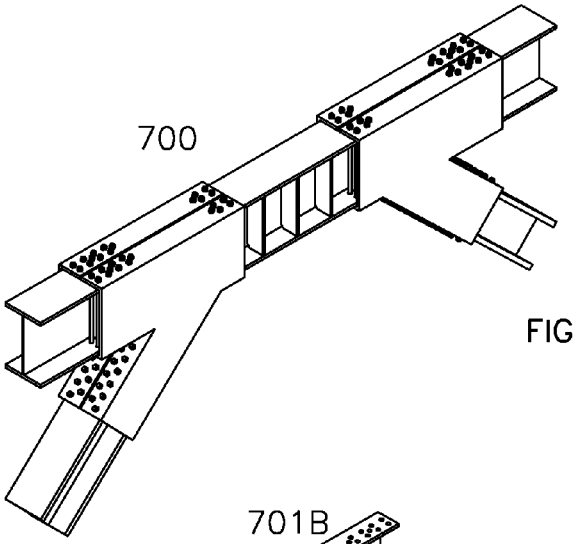
FIGS. 7A-D are schematic diagrams illustrating a moment connection of an eccentrically braced frame (EBF), of the steel frame of FIG. 1B, according to some embodiments.
Figure 7B:
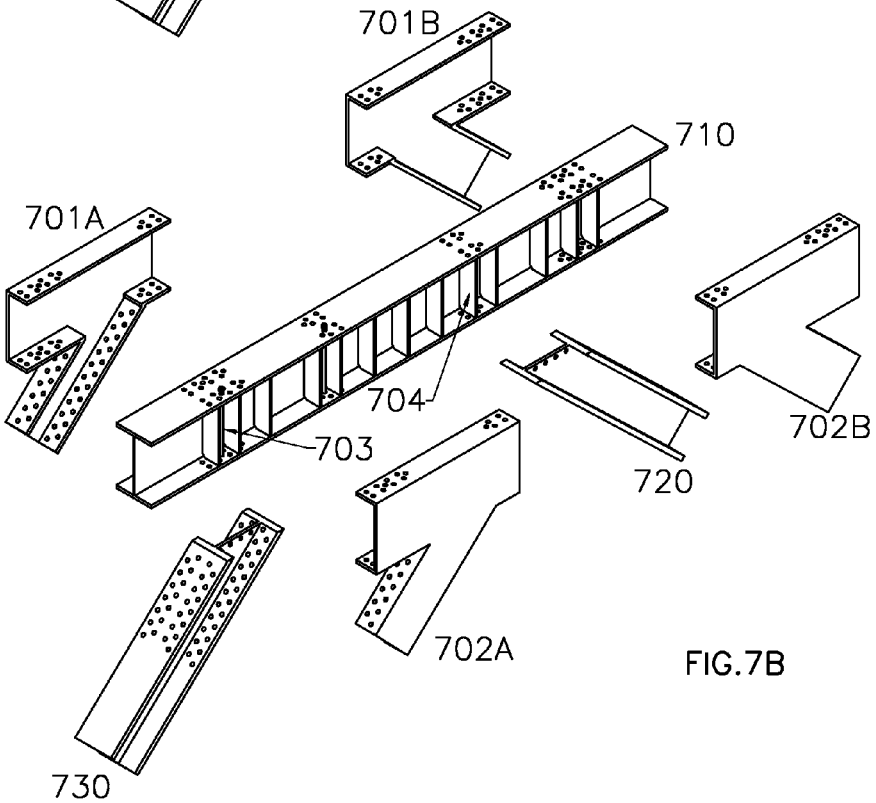
Figure 7C:
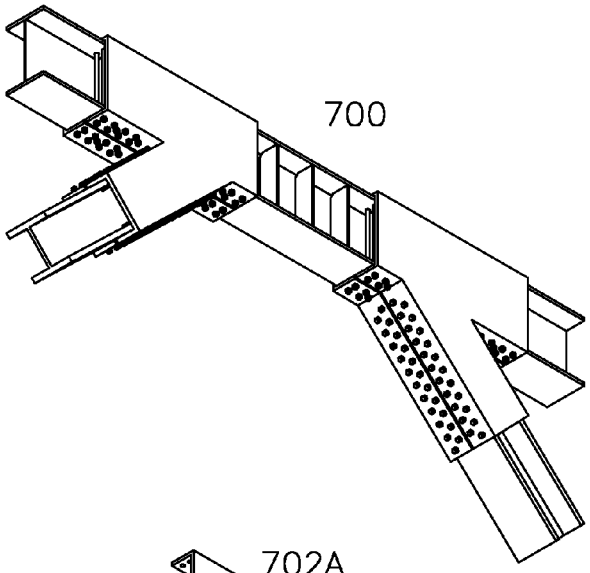
Figure 7D:
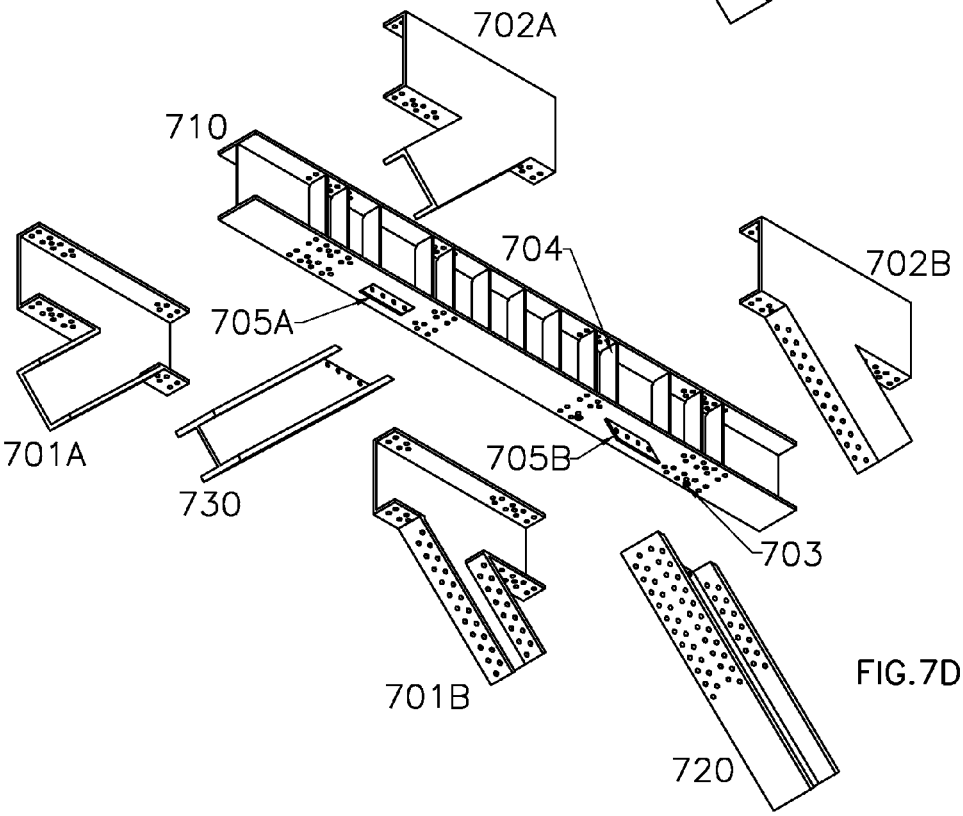
Figure 8A:
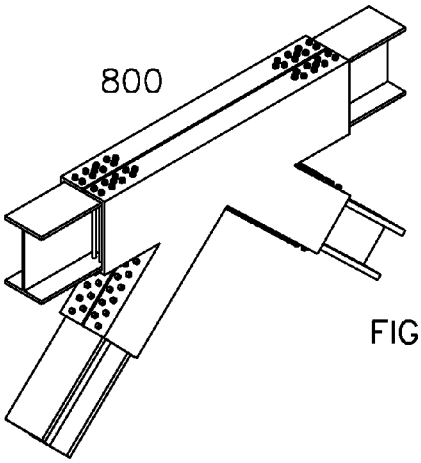
FIGS. 8A-D are schematic diagrams illustrating a moment connection of special concentrically braced frame (SCBF), of the steel frame of FIG. 1C, and the similar connections of the steel truss of FIG. 2D, according to some embodiments.
Figure 8B:
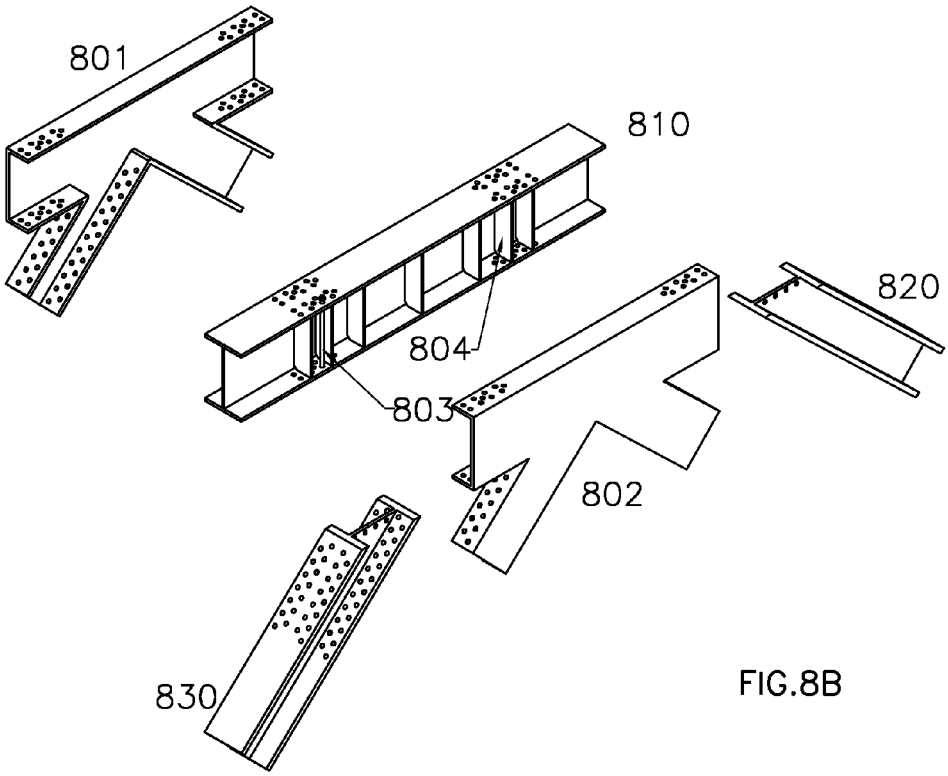
Figure 8C:
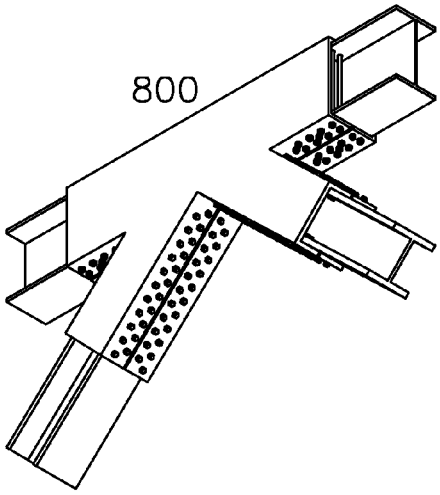
Figure 8D:
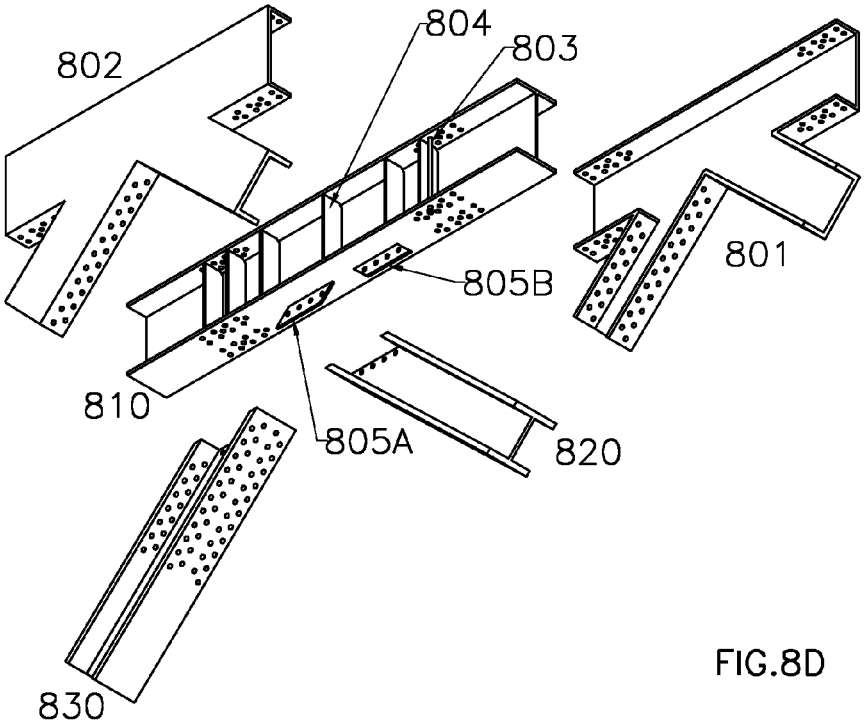
Figure 9A:
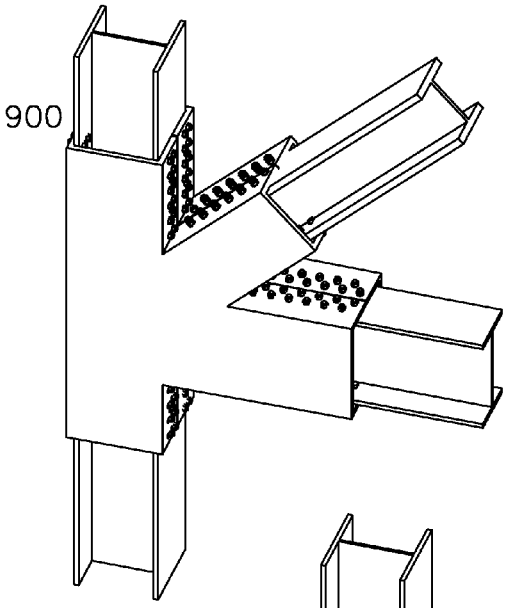
FIGS. 9A-D are schematic diagrams illustrating a moment connection of an EBF and an inverted V SCBF, brace and beam to column connection, of the steel frame of FIG. 1D, and the similar connections of the steel truss of FIG. 2C, according to some embodiments.
Figure 9B:
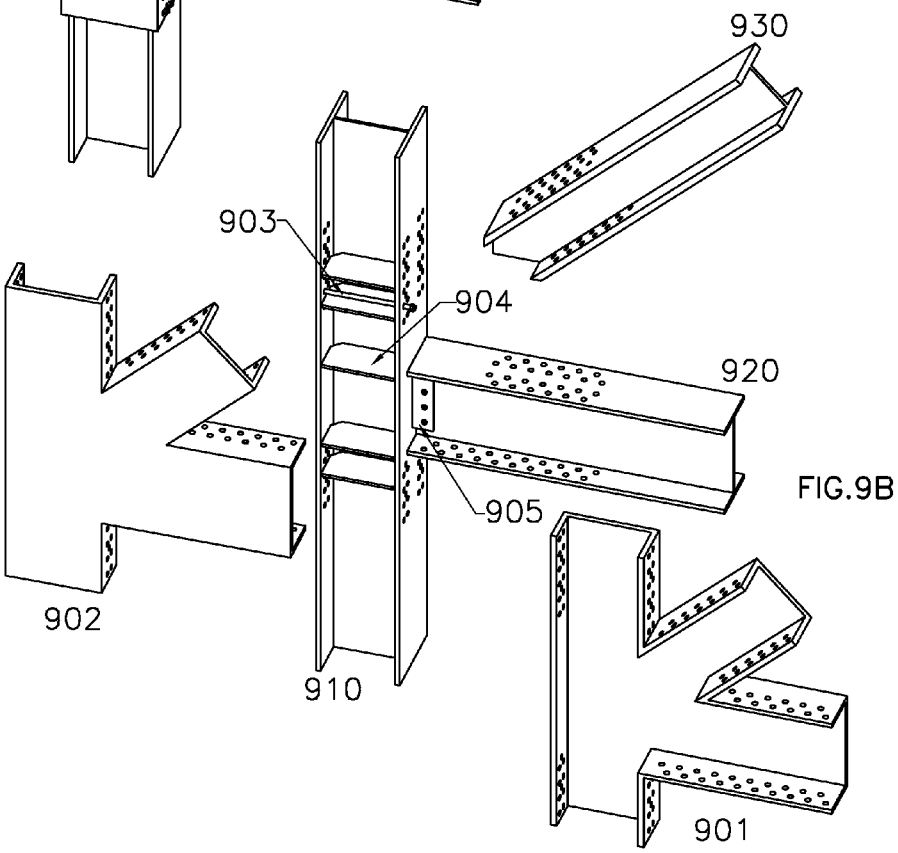
Figures 9C, 9D:
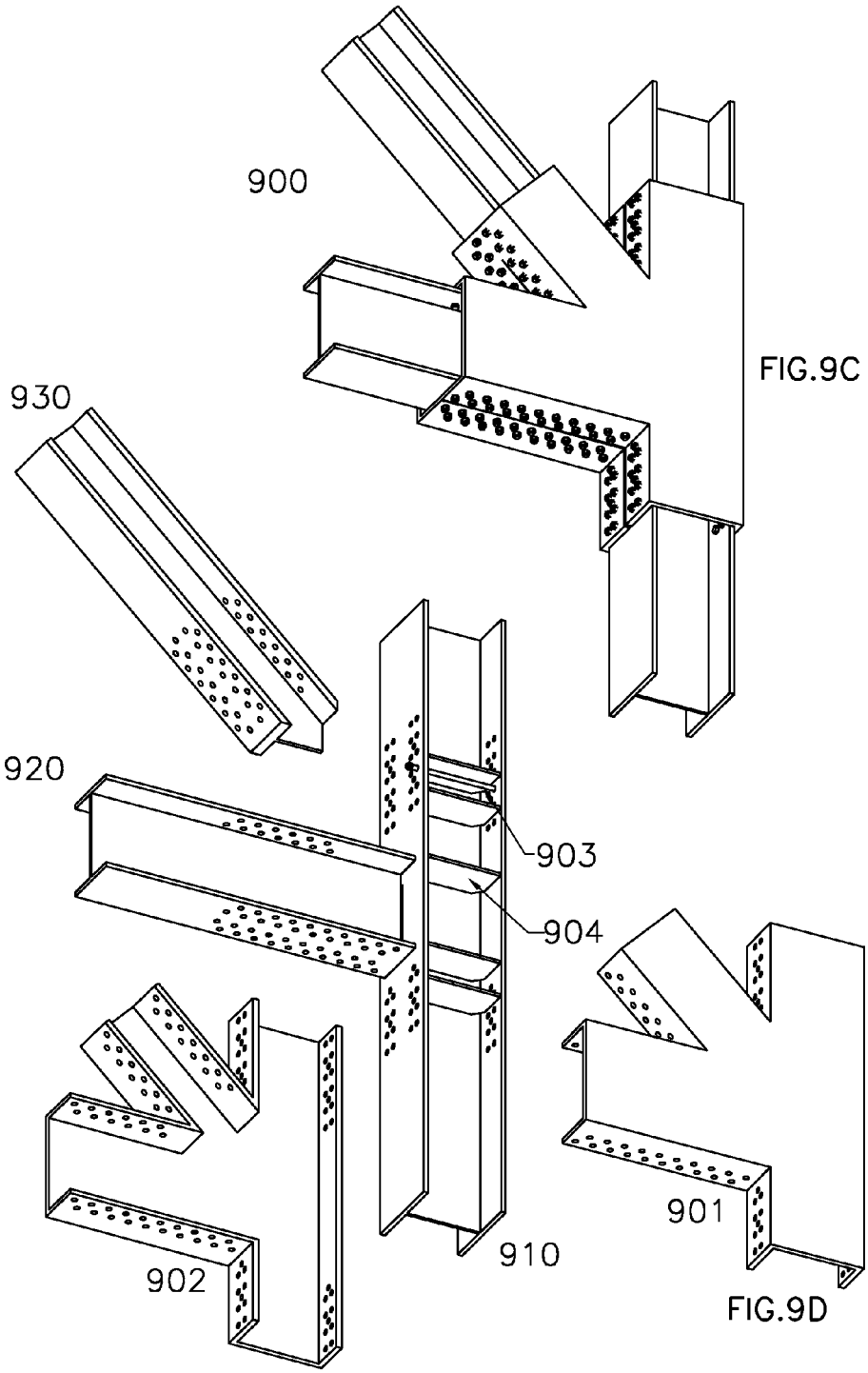
Figure 10A:
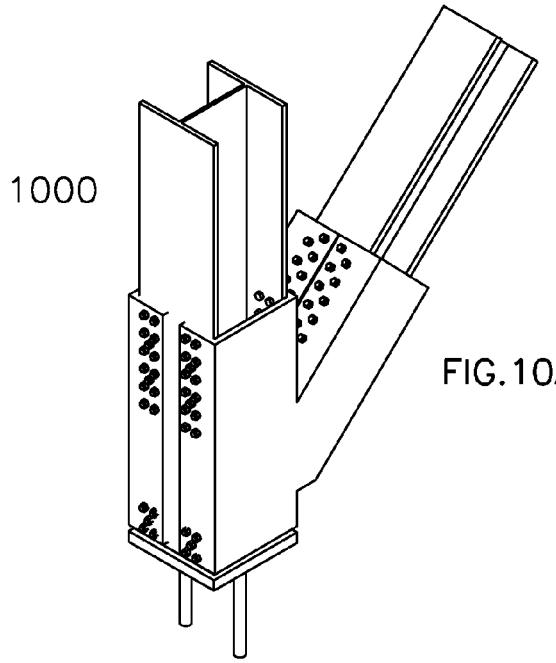
FIGS. 10A-D are schematic diagrams illustrating a moment connection of an EBF and an inverted V SCBF, brace and column connection at a foundation, of the steel frame of FIG. 1B, according to one embodiment.
Figure 10B:
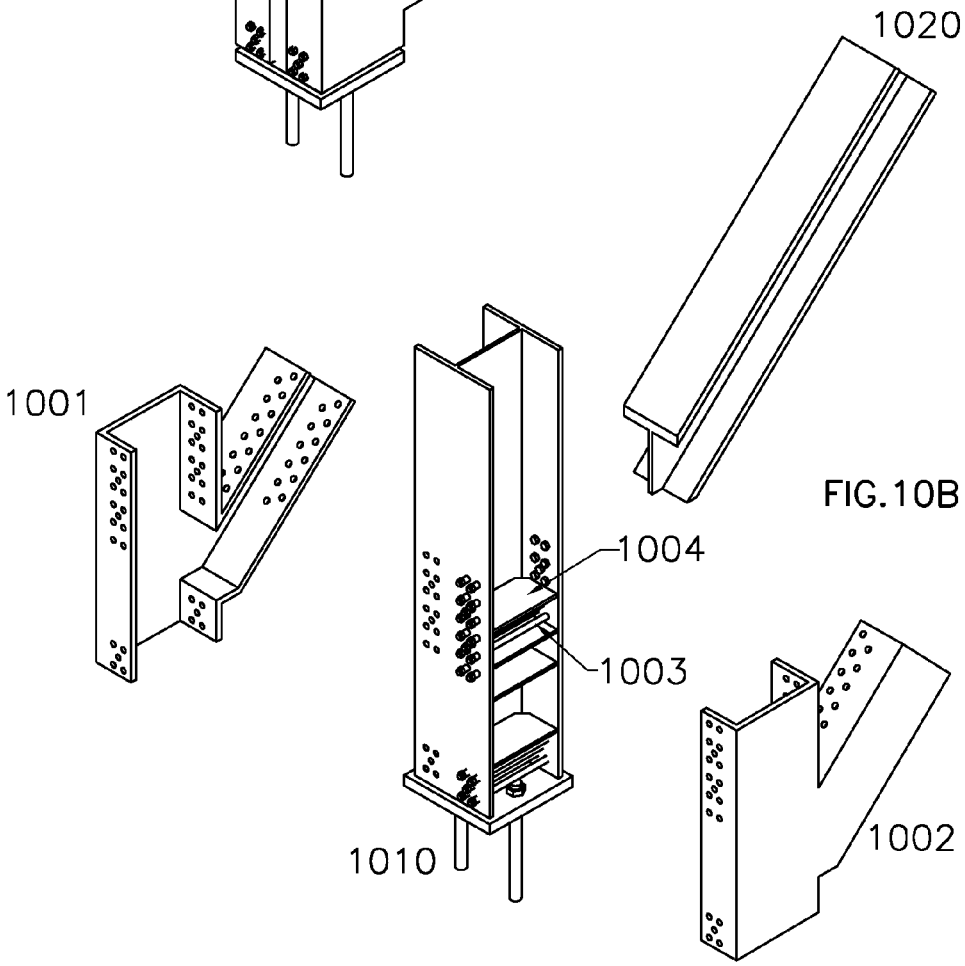
Figure 10C:
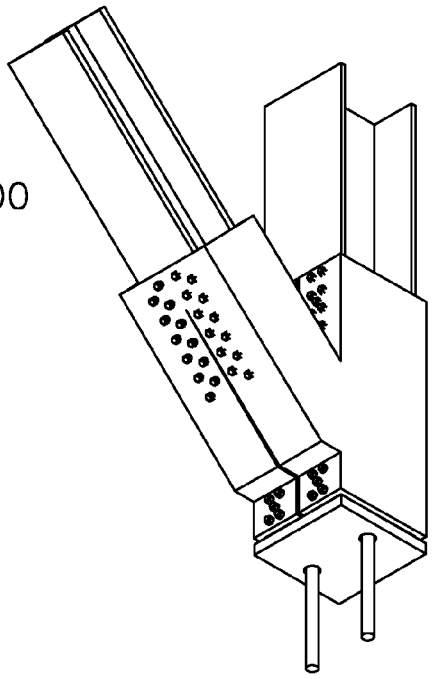
Figure 10D:
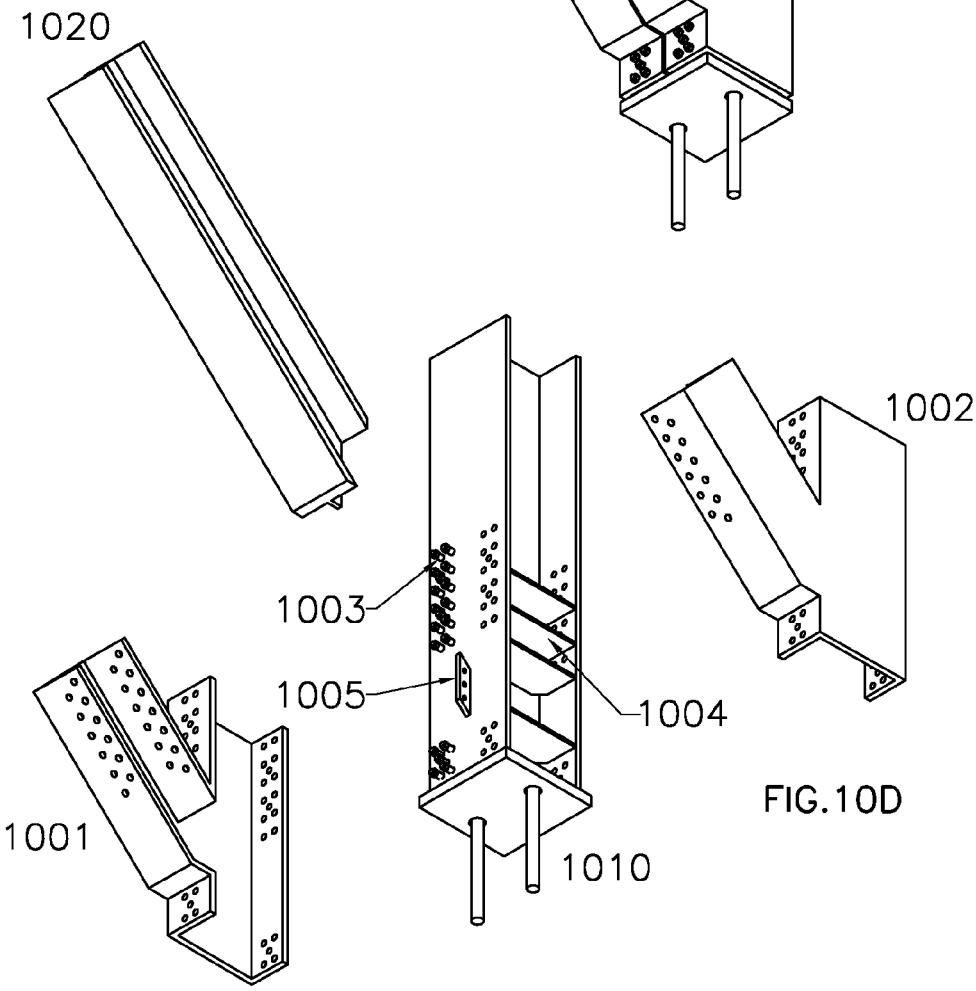
Figure 11A:
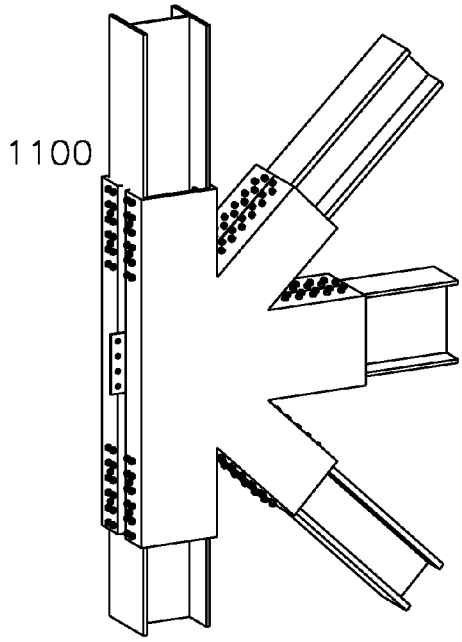
FIGS. 11A-D are schematic diagrams illustrating a moment connection of an SCBF, braces and beam to column connection at a floor, of the steel frame of FIG. 1D, according to one embodiment.
Figure 11B:
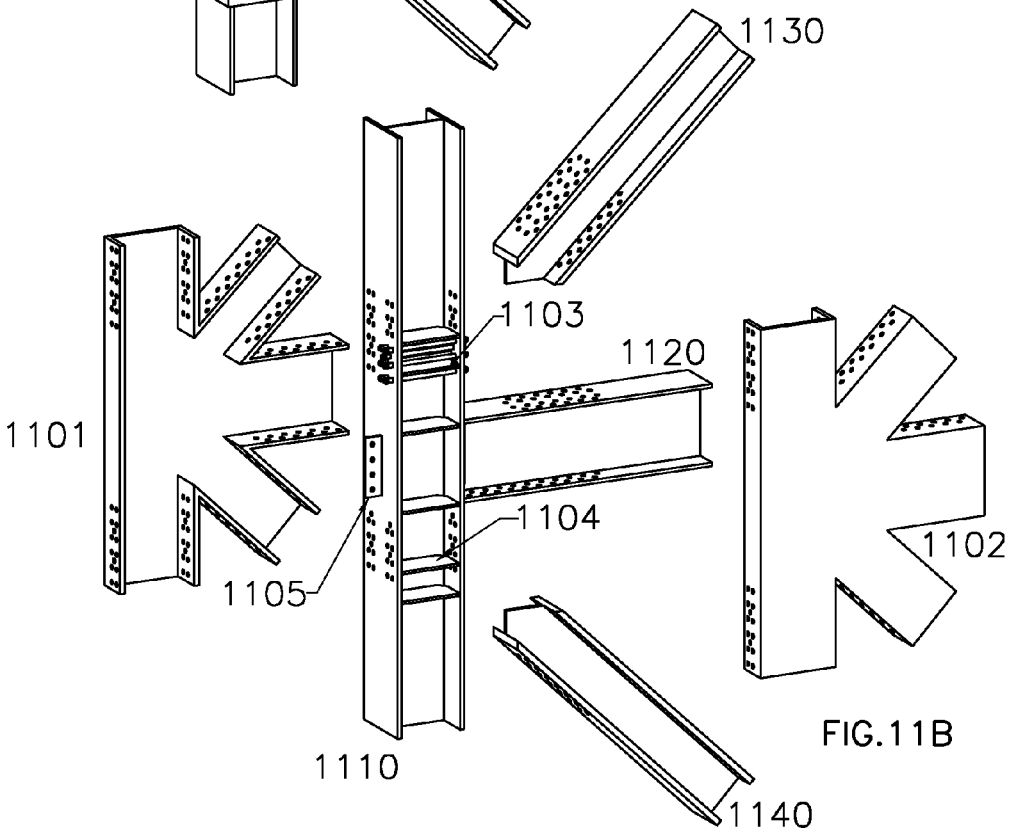
Figure 11C:
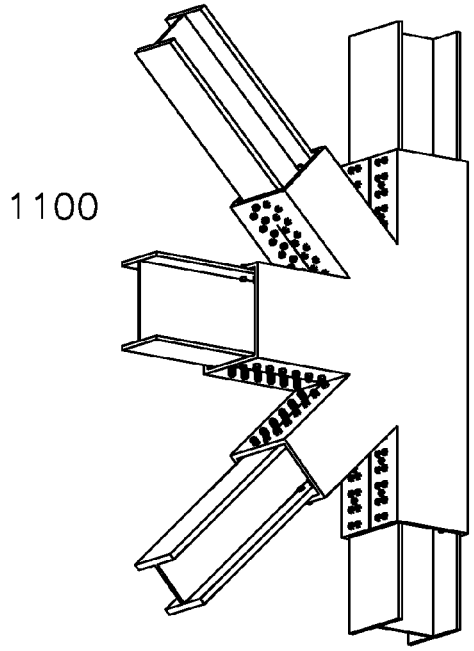
Figure 11D:
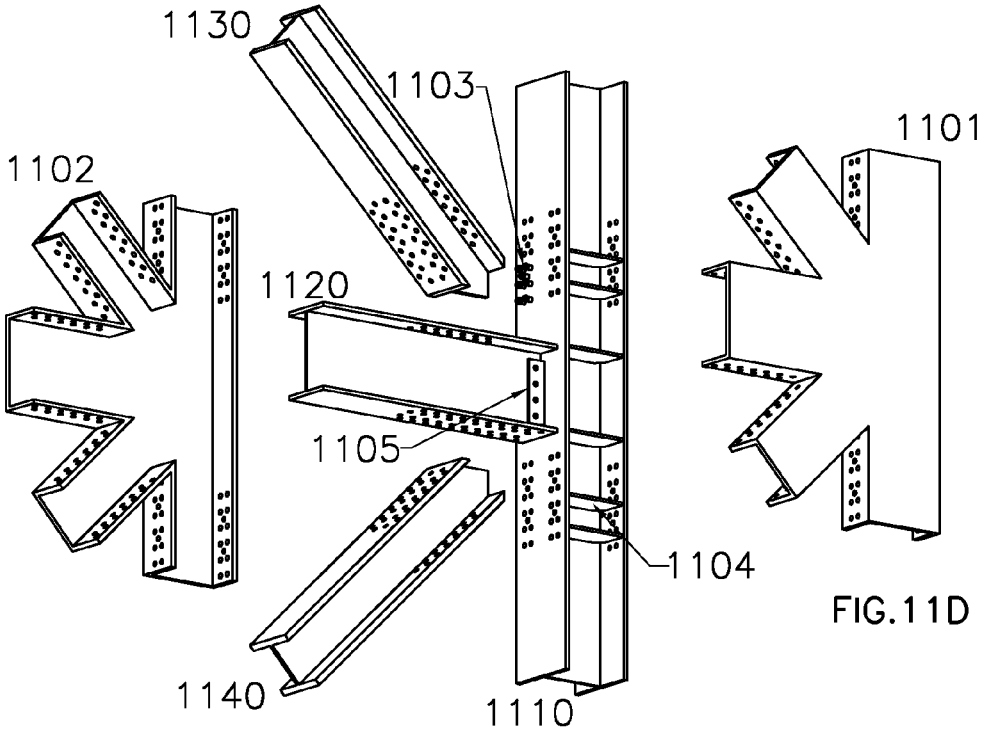
Figure 12A:
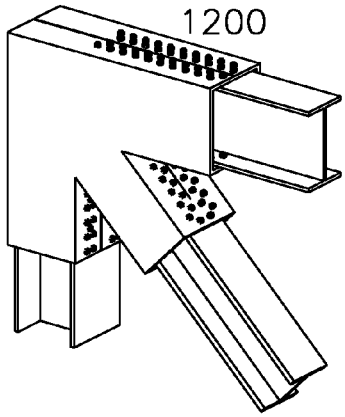
FIGS. 12A-F are schematic diagrams illustrating a moment connection of an SCBF, brace and beam to column connection at a top floor, of the steel frame of FIG. 1E, according to some embodiments.
Figure 12B:
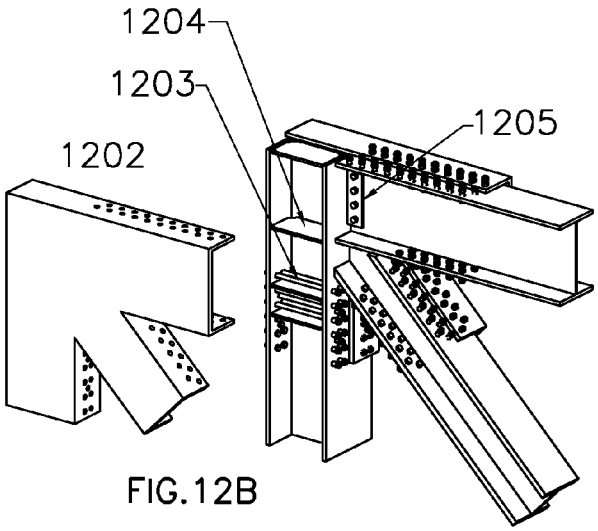
Figure 12C:
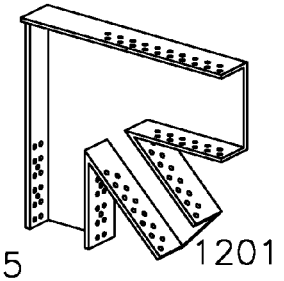
Figure 12C:
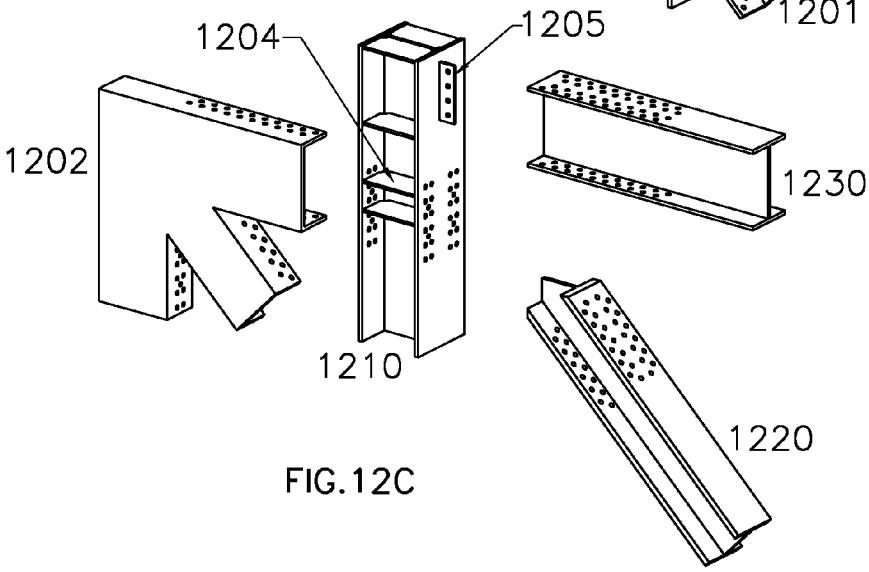
Figure 12D:
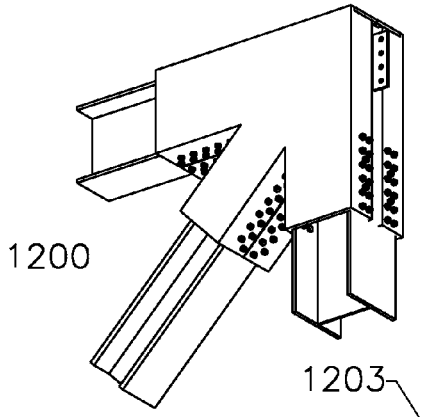
Figure 12E:
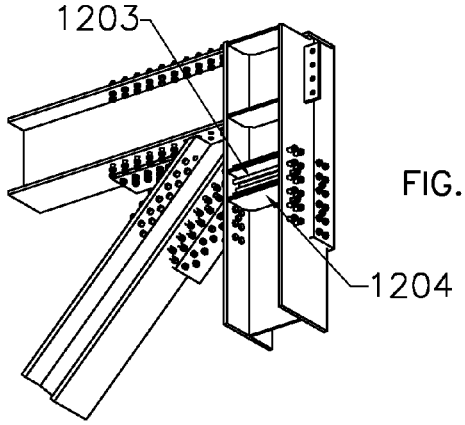
Figure 12F:
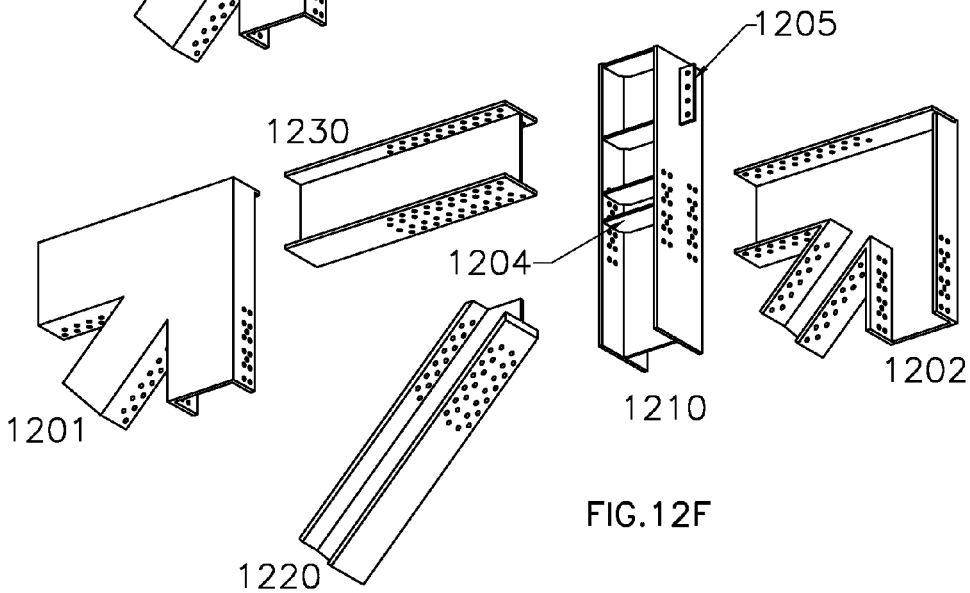

FIGS. 6A-B are schematic diagrams illustrating a moment connection 600 at an intermediate floor, interior bay condition, of the steel frame of FIG. 1A, according to some embodiments.

In this embodiment, the jacket plates 601, 602 have a (+)-shape, and are substantially mirror in configuration. In this implementation, the moment connection 600 supports beams 620, 630 on either side of a post 610 and at different vertical elevations. Here, upper and lower reinforcements are in place. Specifically, tension rods 603, stiffener plates 604 and a shear tag 605 are shown.

Additional variations are possible which do not have 90 degree angle joints and have more than two members. The angles can be 45, 30 or 60 degrees, or any angle needed for a structure. In FIGS. 7-16, numbering labels are consistent with the earlier figures in that connector plates label numbers start with the figure number and end with 01 and 02, tension rods end with 03, web stiffeners end with 04, and shear tags end with 05.

In particular, FIGS. 7A-D are schematic diagrams illustrating a moment connection 700 of an eccentrically braced frame (EBF), of the steel frame of FIG. 1B, according to some embodiments. In this embodiment, the jacket plates 701A, 702A, 701B and 702B have a (y)-shape (rotated), and are substantially mirror in configuration.

Figure 2D:
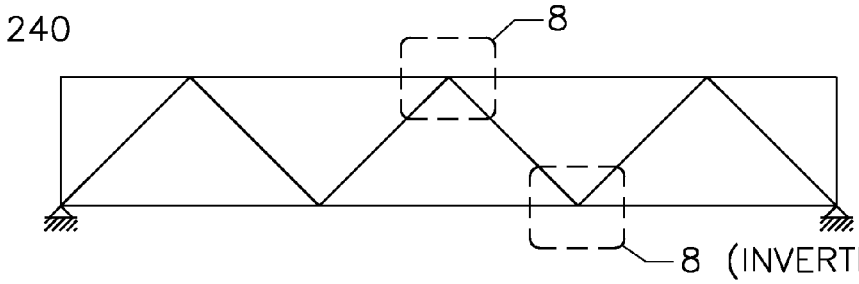

FIGS. 8A-D are schematic diagrams illustrating a moment connection 800 of a special concentrically braced frame (SCBF), of the steel frame of FIG. 1C of the steel truss of FIG. 2D, according to some embodiments. In this embodiment, the jacket plates 801 and 802 have the shape of a combination of two rotated and mirrored (y)-shapes, and are substantially mirror in configuration.

FIGS. 9A-D are schematic diagrams illustrating a moment connection 900 of an EBF and an inverted V SCBF, brace and beam to column connection, of the steel frame of FIG. 1B and the steel truss of FIG. 2C, according to some embodiments. In this embodiment, the jacket plates 901 and 902 have the shape of a combination a rotated (T) and (y), and are substantially mirror in configuration.

FIGS. 10A-D are schematic diagrams illustrating a moment connection 1000 of an EBF and an inverted V SCBF, brace and column connection at a foundation, of the steel frame of FIG. 1B, according to one embodiment. In this embodiment, the jacket plates 1001 and 1002 have a tilted (V)-shape, and are substantially mirror in configuration.

Figure 1D:
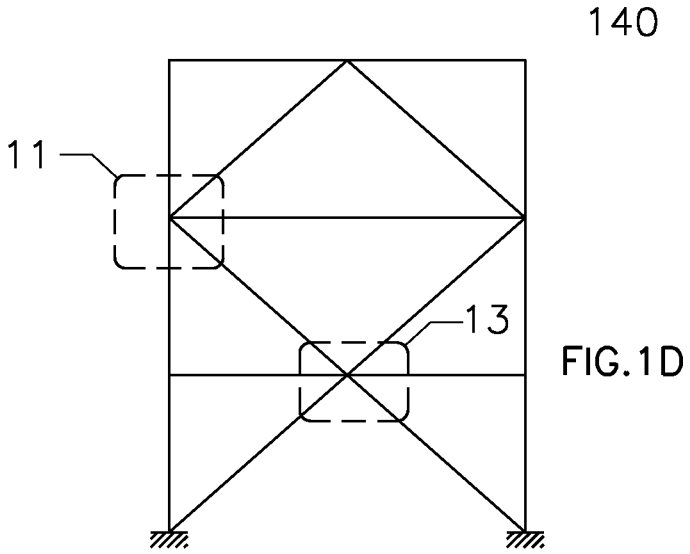

FIGS. 11A-D are schematic diagrams illustrating a moment connection 1100 of an SCBF, brace and beam to column connection at a floor, of the steel frame of FIG. 1D, according to one embodiment. In this embodiment, the jacket plates 1101 and 1102 have the shape of a combination of a (K)-shape and a rotated (T)-shape, and are substantially mirror in configuration.

Figure 1E:
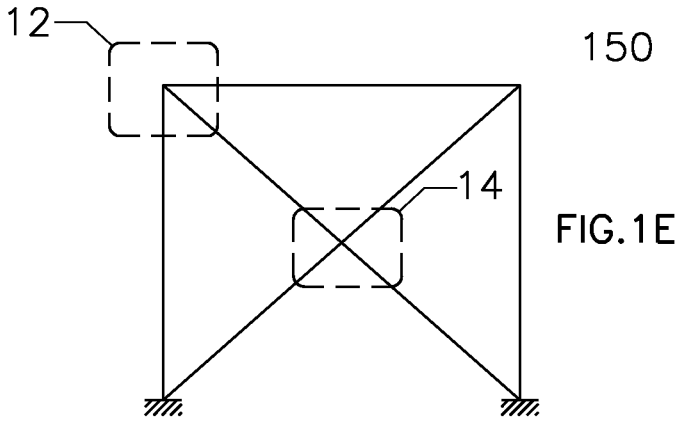

FIGS. 12A-F are schematic diagrams illustrating a moment connection 1200 of an SCBF, brace and beam to column connection at a top floor, of the steel frame of FIG. 1E, according to some embodiments. In this embodiment, the jacket plates 1201 and 1202 have the shape of a combination of a rotated (L)-shape and rotated (V)-shape, and are substantially mirror in configuration.

Figure 13A:
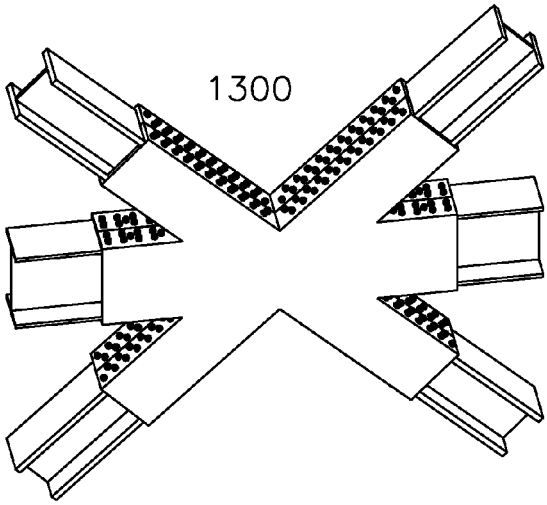
FIGS. 13A-B are schematic diagrams illustrating a moment connection of an SCBF, brace and beam crossing connection, of the steel frame of FIG. 1D, according to some embodiments.
Figure 13B:
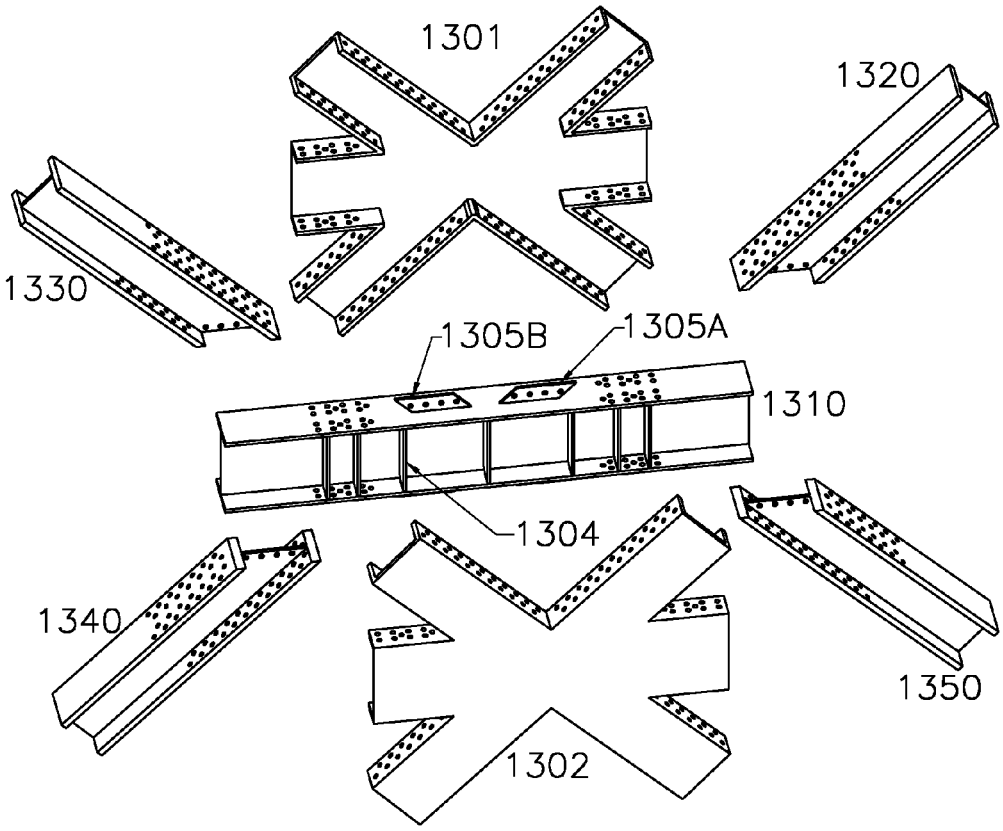

FIGS. 13A-B are schematic diagrams illustrating a moment connection 1300 of an SCBF, brace and beam crossing connection, of the steel frame of FIG. 1D, according to some embodiments. In this embodiment, the jacket plates 1301 and 1302 have a rotated back-to-back dual (K)-shape, and are substantially mirror in configuration.

Figure 14A:
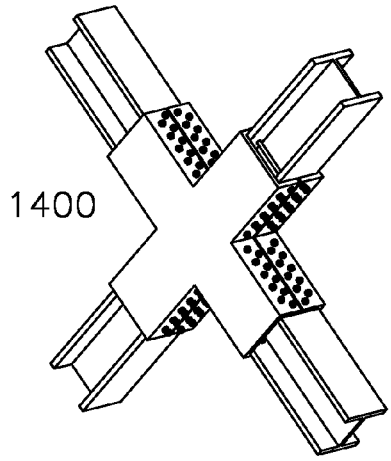
FIGS. 14A-C are schematic diagrams illustrating a moment connection of an SCBF, brace crossing connection without beam condition, of the steel frame of FIG. 1E, according to some embodiments.
Figure 14B:
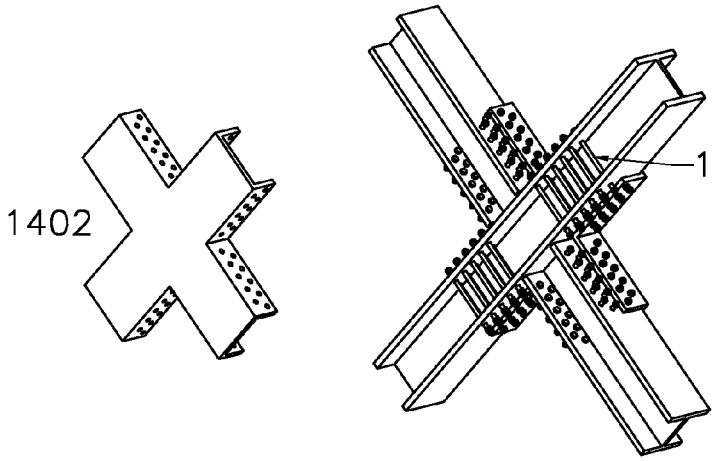
Figure 14C:
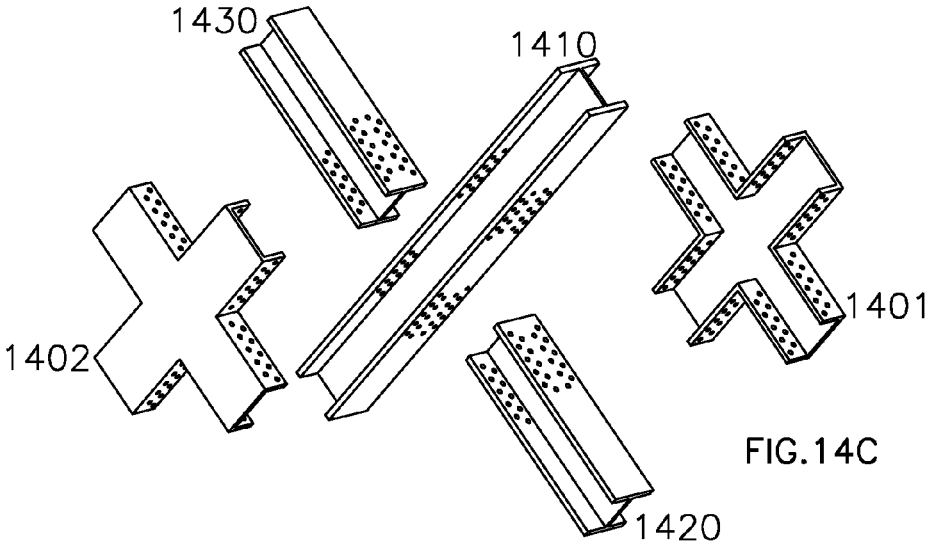

FIGS. 14A-C are schematic diagrams illustrating a moment connection 1400 of an SCBF, brace crossing connection without beam condition, of the steel frame of FIG. 1E, according to some embodiments. In this embodiment, the jacket plates 1401 and 1402 have a (X)-shape, and are substantially mirror in configuration.

Figure 15A:
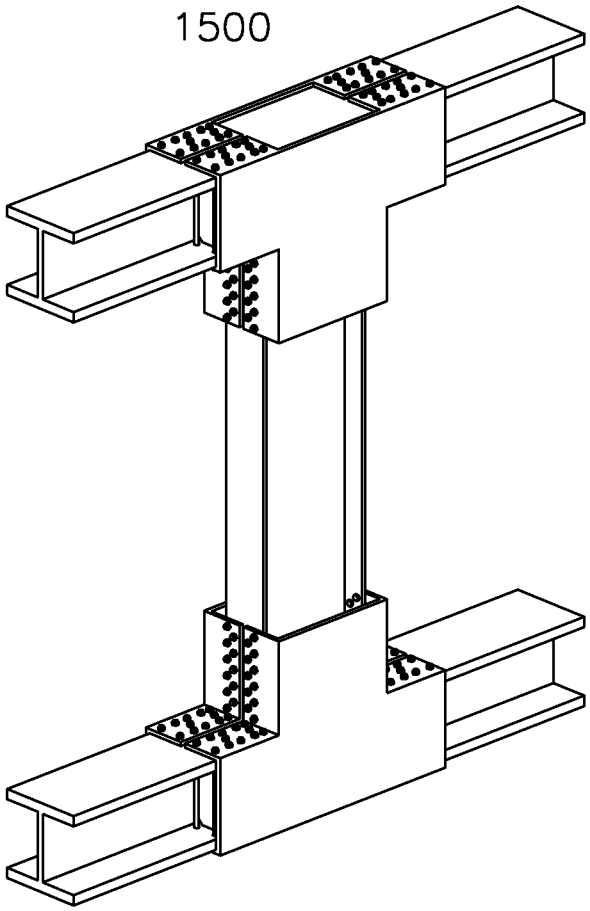
FIGS. 15A-C are schematic diagrams illustrating a Vierendeel truss, connection condition, of the steel truss of FIG. 2A, according to one embodiment.
Figure 15B:
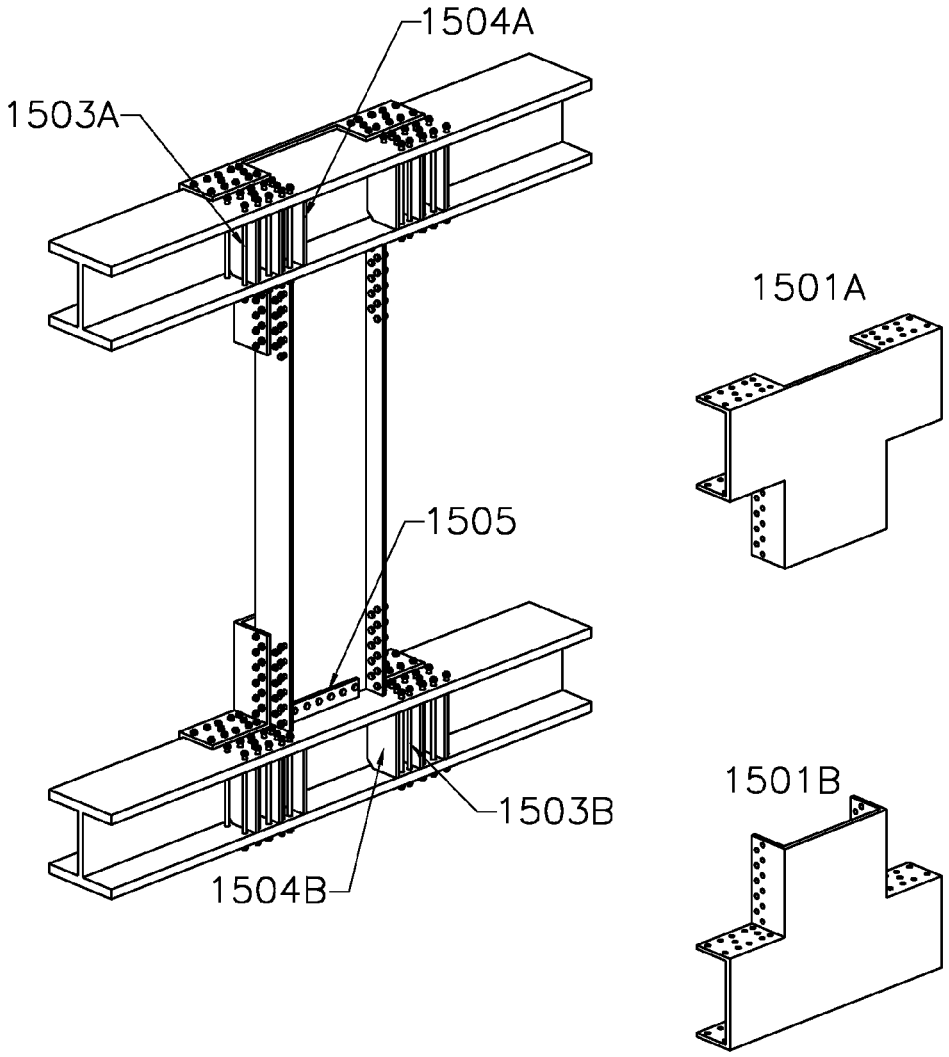
Figure 15C:
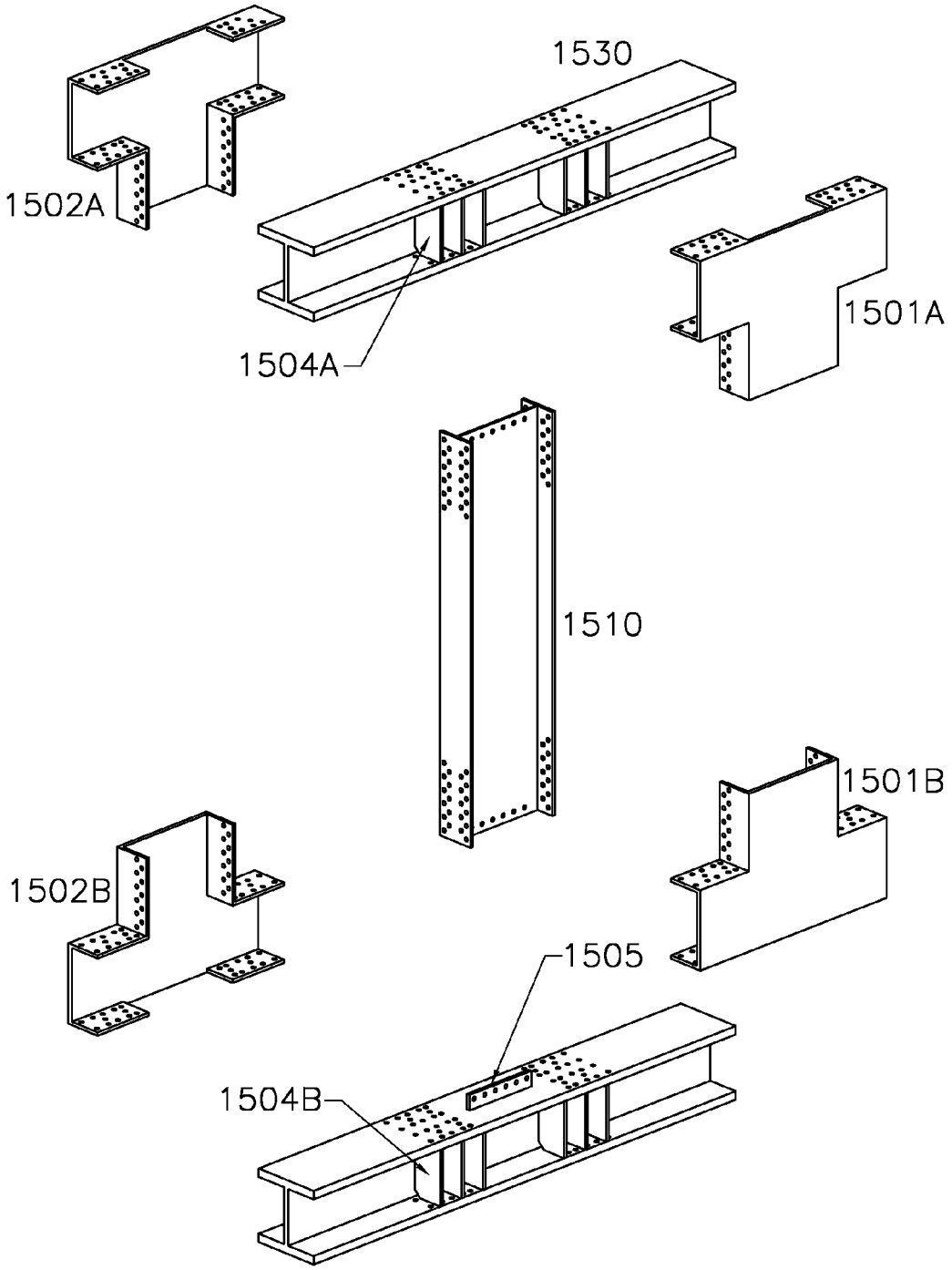
Figure 16A:
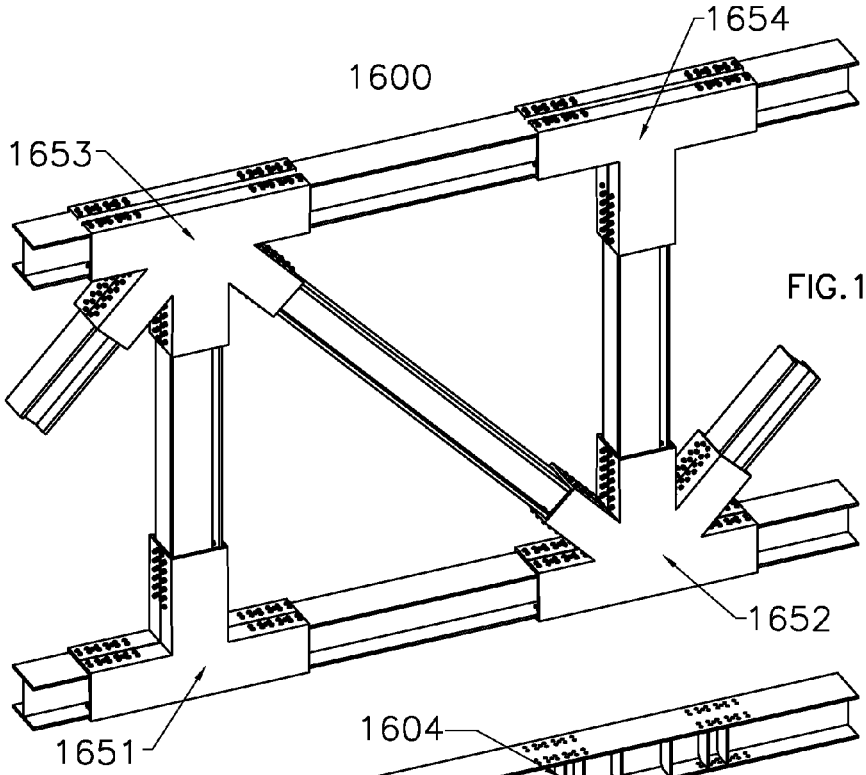
FIGS. 16A-B, are schematic diagrams illustrating a steel bridge truss segment, of the steel truss of FIG. 2B, according to one embodiment.
Figure 16B:
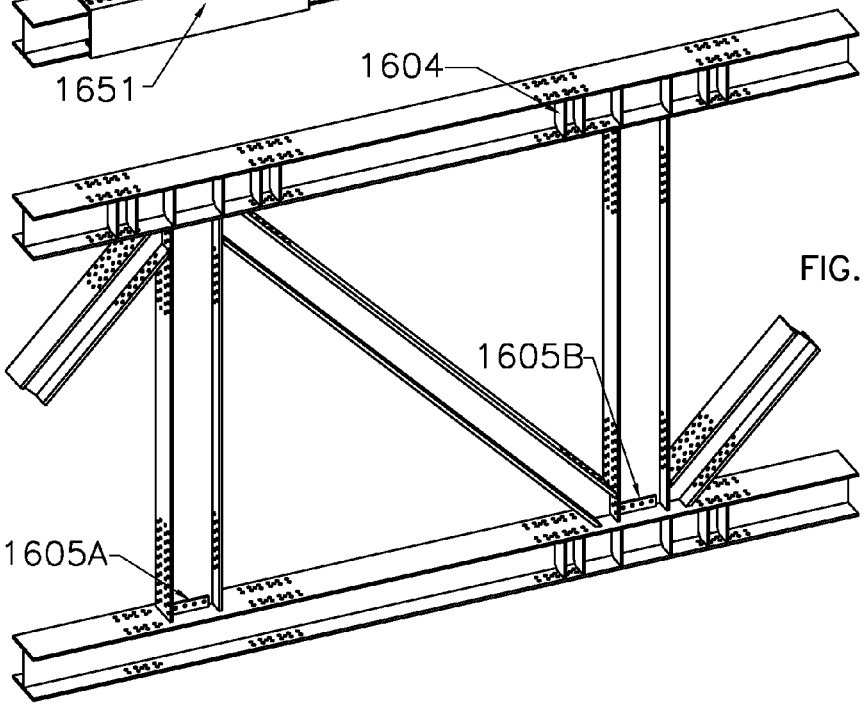

FIGS. 15A-C are schematic diagrams illustrating a Vierendeel truss, connection condition, of the steel truss of FIG. 2A, according to one embodiment. In this embodiment, the jacket plates 1501A and 1502A have a (T)-shape, and are substantially mirror in configuration; the jacket plates 1501B and 1502B have a inverted (T)-shape, and are substantially mirror in configuration.

Finally, FIGS. 16A-B, are schematic diagrams illustrating a steel bridge truss segment, of the steel truss of FIG. 2B, according to one embodiment. In this embodiment, the jacket plates 1651 has a inverted (T)-shape; the jacket plates 1652 and 1653 has the shape of a combination of a rotated (K)-shape and rotated (T)-shape; and the jacket plates 1654 has a (T)-shape.

I claim:

1. A three-dimensional jacket-plate connector to connect at least two steel I-beam members, the jacket-plate connector comprising:

a first three-dimensional jacket plate; and a second three-dimension jacket plate that is substantially a mirror image of the first three-dimensional jacket plate, the two jacket plates bolted to opposite sides of a joint connecting one or more connected secondary I-beam members to a continuous primary I-beam member, wherein each jacket plate comprises a continuous primary C-channel and one or more branching secondary C-channels that intersect to match an angle of the joint formed between a longitudinal axis of the one or more connected secondary I-beam member and a longitudinal axis of the continuous primary I-beam member, wherein each jacket plate comprises a single continuous side web and perimeter clamping flanges perpendicular to the side web, wherein the single continuous side web is formed by webs of intersecting and connected C-channels sharing a common flat plane, wherein the side web and perimeter clamping flanges envelop a void interior space without obstacles against accommodation of I-beam members installed from all the angles of the joint.

2. The connector of claim 1, wherein the perimeter clamping flanges of C-channels of jacket plates clamp over corresponding flanges of I-beams members accommodated inside the jacket plates at the joint.

3. The connector of claim 1, wherein the single continuous side web of each jacket plate forms one of, or a combination of, the following shapes: a (T)-shape, a (V)-shape, a (y)-shape, a (L)-shape, a (K)-shape, a rotated back-to-back dual (K)-shape, a rotated (T)-shape, a tilted (V)-shape, a rotated (y)-shape, a rotated (K)-shape, an (X)-shape, a (cross) or (+)-shape, a rotated (cross) or (+)-shape, a full or partial (asterisk)-shape.

4. The connector of claim 1, wherein the jacket plates comprise: a plurality of pre-drilled holes for a bolted connection of the jacket plates to the primary continuous and the one or more secondary I-beam members, the plurality of pre-drilled holes in the clamping flanges configured for a bolted connection to the flanges of the I-beam members, such that each of the flanges of an I-beam member is covered by one of the corresponding clamping flanges.

5. The connector of claim 4, wherein the pre-drilled holes of the clamping flanges match corresponding pre-drilled holes of the flanges of the I-beam members accommodated inside the joint.

6. The connector of claim 1, wherein the jacket plates have clamping flanges that are bolted to corresponding flanges of the accommodated steel I-beam members.

7. The connector of claim 1, wherein a box space surrounded by opposing flanges of the one or more connected secondary I-beam members in the vertical direction; and by the side web of the jacket plate and the web of the more the one or more connected secondary I-beam members in the horizontal direction, allow access from a front open end for tightening of nuts of bolts that connect the clamping flanges of the jacket plate to the flanges of the connected secondary I-beam member.

8. The connector of claim 1, wherein the continuous primary and the one or more branching secondary C-channels are formed using hot rolling.

9. The connector of claim 1, wherein the interior clear distance between a pair of opposing clamping flanges of a jacket plate is substantially equal to an exterior depth of a cross-section of a corresponding I-beam member.

10. The connector of claim 1, wherein the one or more branching secondary I-beam members are joined to the continuous primary I-beam member at a non-perpendicular angle.

11. The connector of claim 1, wherein the joint comprises at least two branching secondary I-beam members.

12. The connector of claim 1, wherein at least one of the one or more secondary members are joined to the continuous primary member at a non-perpendicular angle.

13. The connector of claim 1, wherein at least one of the perimeter clamping flanges is formed by welding an additional top plate to close a gap in the clamping flanges between the continuous C-channel and at least one of the branching C-channels.

14. A three-dimensional jacket-plate connector to connect at least two steel I-beam members, the jacket-plate connector comprising:

a first three-dimensional jacket plate; and a second three-dimension jacket plate that is substantially a mirror image of the first three-dimensional jacket plate, the two jacket plates bolted to opposite sides of a joint connecting one or more connected secondary I-beam members to a continuous primary I-beam member, wherein each jacket plate comprises a continuous primary C-channel and one or more branching secondary C-channels that intersect to match an angle of the joint formed between a longitudinal axis of the one or more connected secondary I-beam members and a longitudinal axis of the continuous primary I-beam member, Wherein each jacket plate comprises a single continuous side web and perimeter clamping flanges perpendicular to the side web, wherein the single continuous side web is formed by webs of intersecting and connected C-channels sharing a common flat plane, wherein the side web and perimeter clamping flanges envelop a void interior space without obstacles against accommodation of I-beam members installed from all the angles of the joint, and wherein at least one threaded tension rod is installed through the depth of the cross section of the primary C-channel of the jacket plates in order to transfer bending moments and shear forces across the joint, and wherein at least one steel plate stiffener is welded between the flanges of the primary member in order to counteract the compression forces caused by the at least one threaded tension rod.

15. A three-dimensional jacket-plate connector to connect at least two steel I-beam members, the jacket-plate connector comprising:

a first three-dimensional jacket plate; and a second three-dimension jacket plate that is substantially a mirror image of the first three-dimensional jacket plate, the two jacket plates bolted to opposite sides of a joint connecting one or more connected secondary I-beam members to a continuous primary I-beam member, wherein each jacket plate comprises a continuous primary C-channel and one or more branching secondary C-channels that intersect to match an angle of the joint formed between a longitudinal axis of the one or more connected secondary I-beam member and a longitudinal axis of the continuous primary I-beam member, wherein each jacket plate comprises a void interior space without obstacles against accommodation of I-beam members installed from all directions due to flanges being notched out of the continuous primary C-channel at each branching secondary C-channel.

* * * * *